US007572989B2

(12) United States Patent
Deshimaru

(10) Patent No.: US 7,572,989 B2
(45) Date of Patent: Aug. 11, 2009

(54) INFORMATION APPARATUS

(75) Inventor: Teruo Deshimaru, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 174 days.

(21) Appl. No.: 11/288,082

(22) Filed: Nov. 29, 2005

(65) Prior Publication Data

US 2006/0283695 A1 Dec. 21, 2006

(30) Foreign Application Priority Data

Nov. 30, 2004 (JP) ..... 2004-345796

(51) Int. Cl.
*H01H 9/26* (2006.01)

(52) U.S. Cl. ..... 200/5 R; 200/341

(58) Field of Classification Search ..... 200/341–345, 200/512–520, 5 R, 310–314
See application file for complete search history.

(56) References Cited

U.S. PATENT DOCUMENTS

| | | | | |
|---|---|---|---|---|
| 4,570,039 | A * | 2/1986 | Osawa et al. | 200/5 A |
| 5,215,187 | A * | 6/1993 | Ping-Chieng et al. | 200/517 |
| 5,386,091 | A * | 1/1995 | Clancy | 200/517 |
| 5,812,116 | A * | 9/1998 | Malhi | 345/168 |
| 6,204,462 | B1 * | 3/2001 | Huang | 200/345 |
| 6,242,705 | B1 * | 6/2001 | Huang | 200/520 |
| 6,392,176 | B1 * | 5/2002 | Tsai | 200/344 |
| 6,437,682 | B1 * | 8/2002 | Vance | 338/185 |
| 6,730,868 | B1 * | 5/2004 | Watanabe | 200/344 |
| 6,919,524 | B2 * | 7/2005 | Imamura et al. | 200/512 |
| 6,953,900 | B2 * | 10/2005 | Sottong | 200/5 R |
| 7,084,359 | B1 * | 8/2006 | Konno | 200/1 B |
| 7,397,006 | B2 * | 7/2008 | Miyauchi | 200/339 |
| 7,416,310 | B1 * | 8/2008 | Savicki, Jr. | 362/95 |
| 7,419,297 | B2 * | 9/2008 | Noirjean | 368/187 |
| 7,497,582 | B1 * | 3/2009 | Savicki, Jr. | 362/95 |

FOREIGN PATENT DOCUMENTS

| | | |
|---|---|---|
| JP | 63-315280 | 12/1988 |
| JP | 1-278384 | 11/1989 |
| JP | 2536761 | 5/1997 |

* cited by examiner

*Primary Examiner*—Michael A Friedhofer
*Assistant Examiner*—Lisa N Klaus
(74) *Attorney, Agent, or Firm*—Banner & Witcoff, Ltd

(57) ABSTRACT

An information apparatus includes a first cover member that includes an input device capable of inputting data and may be capable of opening and closing with respect to a second cover member, and an opening/closing detection device that detects a status of the first cover member whether the first cover member is opened or closed with respect to the second cover member. The input device includes a plurality of keyswitches, each of which includes a switching portion having a circuit board, which may be provided with a fixed contact, and a rubber spring, which has a traveling contact capable of contacting and separating from the fixed contact and which is capable of being elastically deformed by pressure, and the opening/closing detection device includes at least one of the plurality of keyswitches.

27 Claims, 22 Drawing Sheets

INFORMATION APPARATUS

CROSS REFERENCE TO RELATED APPLICATION

This application claims priority from Japanese Patent Application No. 2004-345796, filed on Nov. 30, 2004, the subject matter of which is incorporated herein in its entirety by reference.

BACKGROUND

1. Technical Field

Aspects of the present invention relate to an information apparatus having a cover opening/closing detection device.

2. Related Art

Conventionally, information apparatuses, such as facsimile machines, copying machines, and printers, include an opening/closing detection device of a discrete part, such as a micro switch, that detects a status (opening and closing) of a cover member capable of opening and closing with respect to a housing of the information apparatus.

For example, some approaches include an apparatus in which a through hole is formed in a hosing of the apparatus and a protrusion is provided at a cover member. When the cover member is closed, the protrusion passes through the through hole to press a micro switch provided in a recess of the housing.

Other approaches include a device including a contactless switch in which a hall IC is integrated as a switch for detecting opening and closing of a cover member, wherein a magnet for turning the hall IC on and off according to the opening and closing of the cover member is embedded in the cover member at a position corresponding to the hall IC.

However, these approaches described above, a discrete part, such as an expensive hall IC or photosensor, is used for the switches for detecting the opening and closing the cover members. Therefore, costs, such as a parts cost and an assembly cost, will be increased.

In addition, a space for mounting the switch needs to be reserved in the apparatus, and the switch needs to be installed at a position where an on and off operation of the switch is surely performed.

Further, a special harness is required in order to mount the switch of a discrete part. In this case, the special harness is routed in the cover member, so that noise is prevented or reduced in the apparatus. As a result, a manufacturing cost will be increased due to the need of the special harness and the attempts to reduce noise.

Because the switch of a discrete part is mounted, a positional relationship between the switch and a switch operating side needs to be extremely precisely determined. Thus, a cost for such a fine adjustment increases.

SUMMARY

Aspects of the invention an improved system for detecting whether a cover member of a device (which may be used for inputting data) has been closed using a keyswitch.

BRIEF DESCRIPTION OF THE DRAWINGS

Illustrative aspects of the invention will be described in detail with reference to the following figures.

DETAILED DESCRIPTION

It is noted that various connections are set forth between elements in the following description. It is noted that these connections in general and, unless specified otherwise, may be direct or indirect and that this specification is not intended to be limiting in this respect.

According to at least one aspect of the disclosure, an information apparatus includes a first cover member that includes an input device capable of inputting data and may be capable of opening and closing with respect to a second cover member, and an opening/closing detection device that detects a status of the first cover member whether the first cover member is opened or closed with respect to the second cover member. The input device includes a number of keyswitches, each of which includes a switching portion having a circuit board, which may be provided with a fixed contact, and a rubber spring, which has a traveling contact capable of contacting and separating from the fixed contact and which is capable of being elastically deformed by pressure, and the opening/closing detection device includes at least one of the number of keyswitches.

In the information apparatus according another aspect of the disclosure, the information apparatus includes the number of continuous keyswitches, each of which includes the switching portion having the circuit board, which may be provided with the fixed contact, and the rubber spring, which has the traveling contact capable of contacting and separating from the fixed contact and which is capable of being elastically deformed by pressure. Further, the opening/closing detection device includes at least one of the number of keyswitches. With this structure, a special switch for detecting the opening and closing of the first cover member, a special harness for connecting the special switch, and the prevention measures for noise, which may be to be caused by the provision of the special harness, can be eliminated. In addition, assembly costs for those parts and a cost for fine adjustment for positioning those parts can be reduced. Further, the fixed contacts of the circuit board and the rubber springs are divided into blocks by function, so that a keyswitch for detecting the opening and closing of the first cover member can be provided in the empty space left between the blocks. Therefore, the circuit board and the rubber spring sheet can be obtained with no additional costs.

Illustrative embodiments of the disclosure will be described with reference to the accompanying drawings. First, a schematic structure of an information apparatus 1 according to a first illustrative embodiment will be described with reference to FIGS. 1 to 5.

Figure 1:
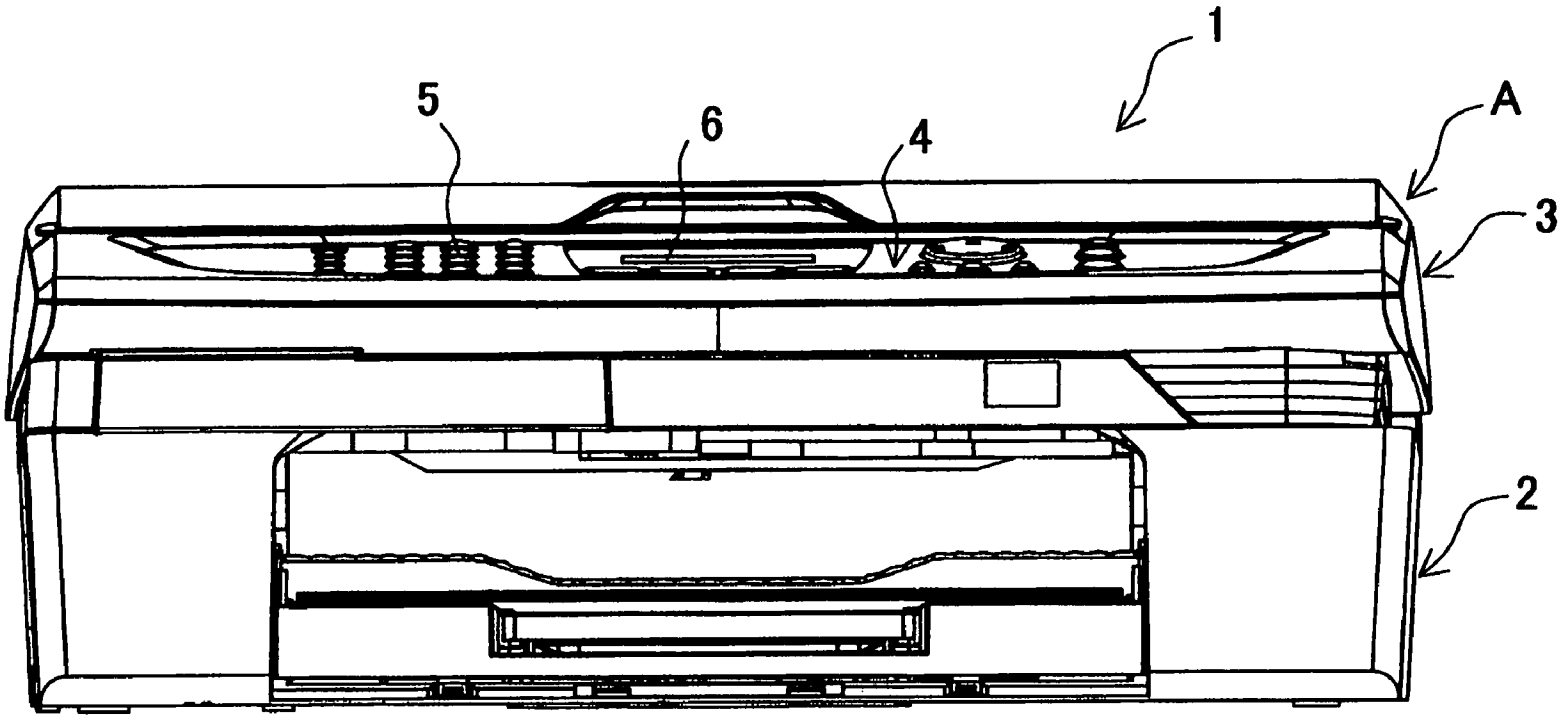
FIG. 1 is a front view showing an appearance of an information apparatus according to a first illustrative embodiment of the disclosure.
Figure 2:
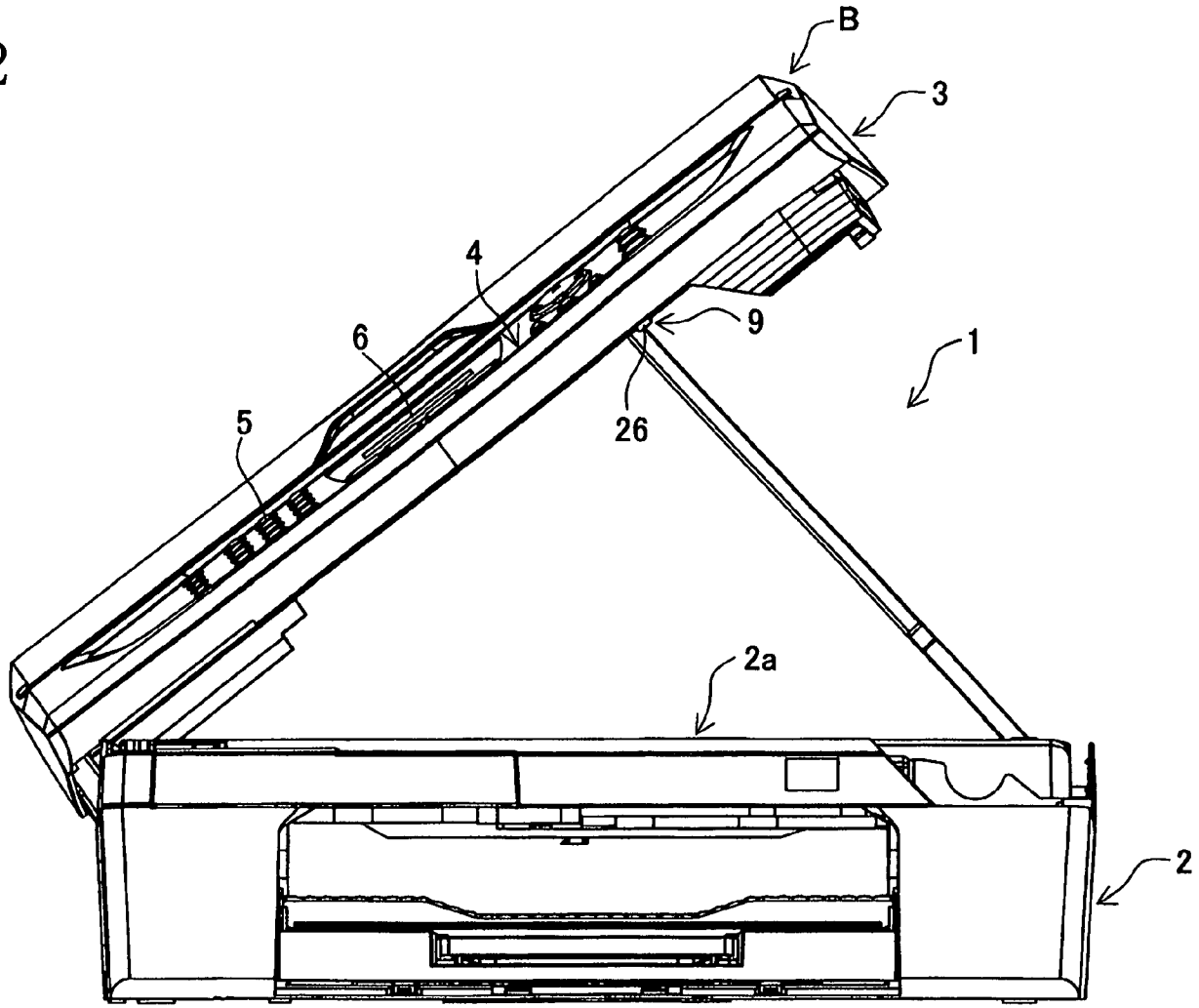
FIG. 2 is a front view of the information apparatus of FIG. 1 with a first cover member is opened from a side in accordance with aspects of the present invention.

As shown in FIGS. 1 and 2, the information apparatus 1 has a clamshell structure in which a first cover member 3 and a second cover member 2 (functioning as a housing) are connected with each other at their one ends such that the first cover member 3 can be opened and closed with respect to the second cover member 2. That is, the first cover member 3 may be capable of pivoting up and down about its one end between a covering position A (FIG. 1) where the first cover member 3 covers the second cover member 2 to close an opening 2*a* and an uncovering position B (FIG. 2) where the first cover member 3 is separated from the second cover member 2 to reveal the opening 2*a*. In the following description, the near side of FIG. 1 will be referred to as the front of the information apparatus 1, the far side of FIG. 1 will be referred to as the back or rear of the information apparatus 1, and the right and left of FIG. 1 will be referred to as the right and left of the information apparatus 1, respectively. More specifically, in this illustrative embodiment, the information apparatus 1 may be a multifunction device to which the disclosure is applied, wherein the multifunction device has a printing function, a copying function, a scanning function, and a facsimile function. The first cover member 3 may be disposed above the second cover member 2 and has an image reader built therein to implement the copying function and the facsimile function in the information apparatus 1. In the first cover member 3, an operating panel 4 having various keyswitches 5 (functioning as an input device) and a liquid crystal display (LCD) portion 6 may be provided at the front of the image reader. The first cover member 3 further includes an opening/closing detection switch 17 (functioning as an opening/closing detection device) that detects a state (opening and closing) of the first cover member 3 with respect to the second member 2. The second cover member 2 includes a sheet supply cassette, which is capable of being attached to and detached from the second cover member 2 and may be capable of loading a number of recording sheets in layers therein. The second cover member 2 further includes a sheet supply/separation mechanism, a sheet conveying mechanism, an ink-jet recording mechanism, and a sheet ejection mechanism, all of which are not shown in the drawings. The information apparatus 1 may be designed so as to be connectable to an external personal computers (not shown) and a communications device (not shown), such as external facsimile machines, through communications lines. Upon input of a recording command from an external personal computer, a communications device, or through the operating panel 4 of the information apparatus 1, a single recording sheet may be separated from the stack of the recording sheets in the sheet supply cassette by the sheet supply/separation mechanism, and may be conveyed by the sheet conveying mechanism. Then, an image may be recorded onto the supplied recording sheet and the sheet having the image may be ejected by the sheet ejection mechanism. With this structure, while the information apparatus 1 is normally used, the first cover member 3 may be located at the covering position A to cover the opening 2*a* of the second cover member 2. When a user needs to perform an operation in the second cover member 2, for example, when a paper jam occurred in the second cover member 2 needs to be cleared or when an ink cartridge needs to be replaced with a new one, the user performs an appropriate operation in the second cover member 2 while the opening 2*a* of the second cover member 2 is opened by rotating the first cover member 3 to the uncovering position B from the covering position A.

Figure 3:
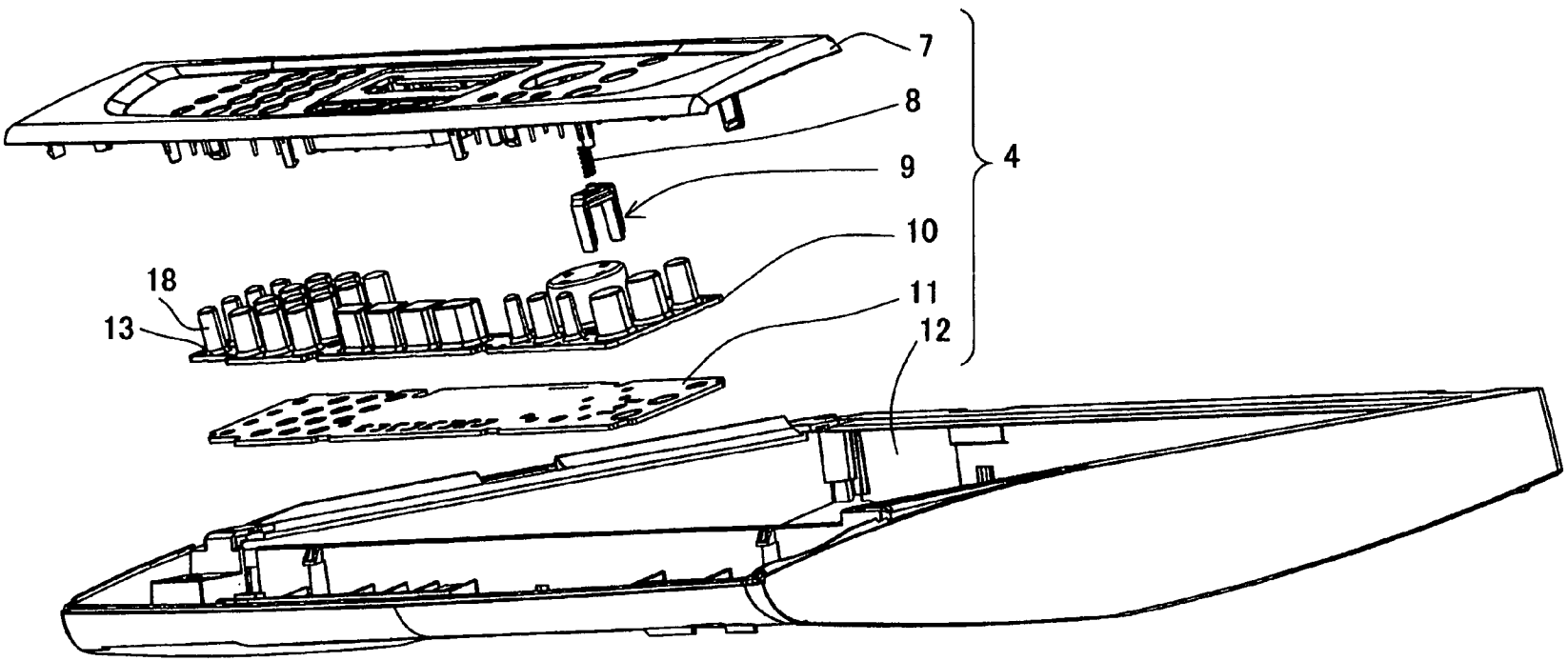
FIG. 3 is an exploded view of an operating panel provided at the first cover member according to the first illustrative embodiment in accordance with aspects of the present invention.
Figure 4A:
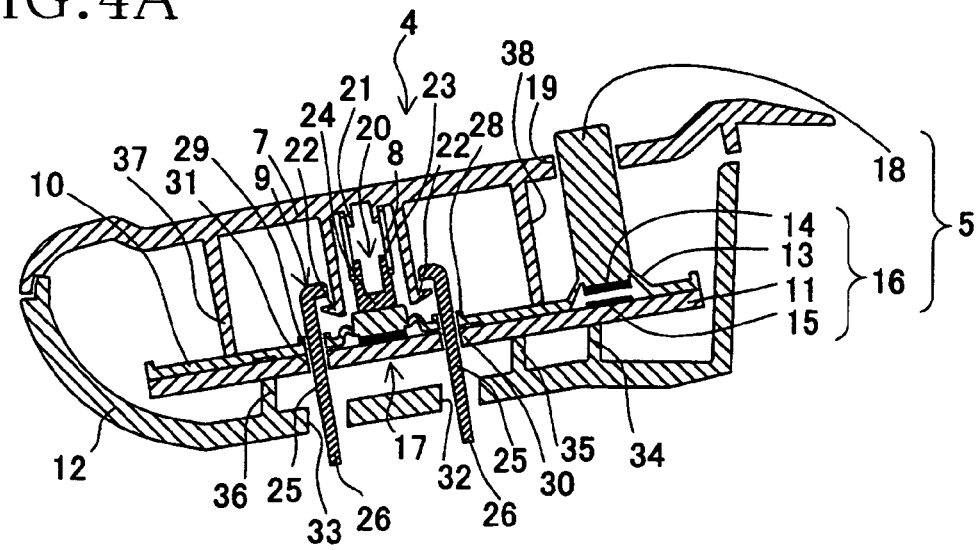
FIG. 4A is a sectional view of the operating panel provided with a number of keyswitches and an opening/closing detection switch according to the first illustrative embodiment, wherein the first cover member is opened and the opening/closing detection switch is in an on state in accordance with aspects of the present invention.
Figure 4B:
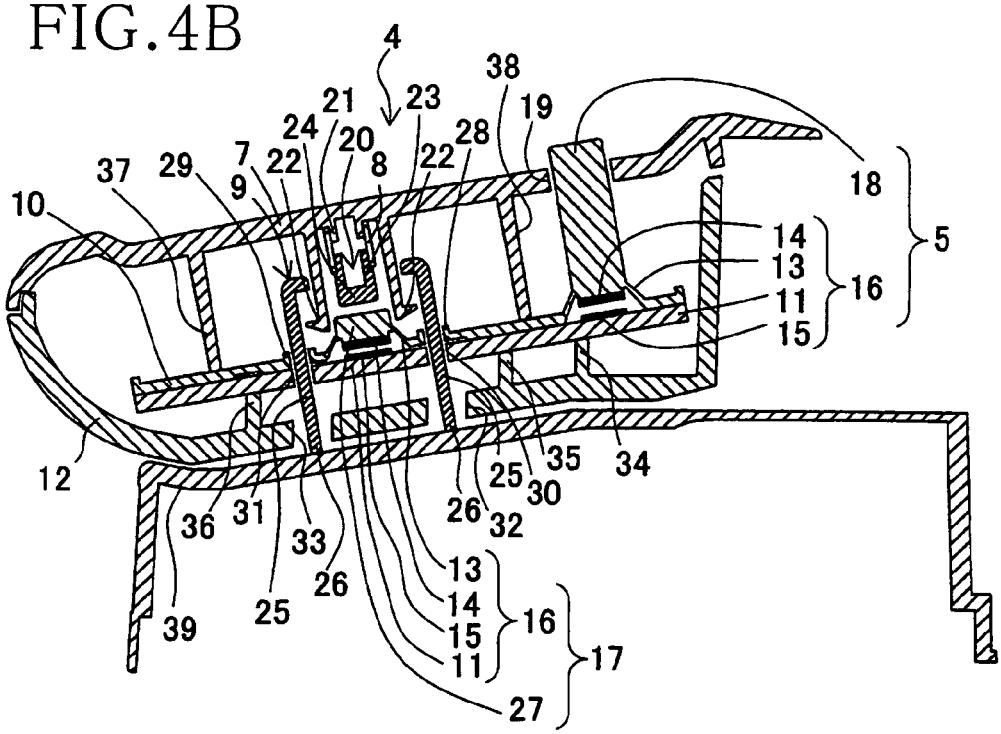
FIG. 4B is the sectional view of the operating panel provided with the number of keyswitches and the opening/closing detection switch according to the first illustrative embodiment, wherein the first cover member is closed and the opening/closing detection switch is in an off state.

Next, a structure of the operating panel 4 (except the LCD portion 6) will be described with reference to FIG. 3. As shown in FIG. 3, the operating panel 4 includes an operating panel cover 7, a first cover 12, a circuit board 11, and a rubber spring sheet 10. The operating panel cover 7 and the first cover 12 sandwich the circuit board 11 and the rubber spring sheet 10 therebetween while the rubber spring sheet 10 is disposed above the circuit board 11. The circuit board 11 may be provided with a number of fixed contacts 15 (FIGS. 4A and 4B). The rubber spring sheet 10 includes a number of rubber springs 13 which are integral with and continuous with each other and each of which has a traveling contact 14 and a head portion 18 (FIGS. 4A and 4B). The number of keyswitches 5 (FIGS. 4A and 4B) are implemented by a combination of the circuit board 11 and the rubber spring sheet 10. In order to use one of the number of keyswitches 5 as the opening/closing detection switch 17, an actuator 9 (functioning as a release member) and a spring 8 (functioning as an urging member) are provided so as to be sandwiched between the operating panel cover 7 and the first cover 12.

Figure 5:
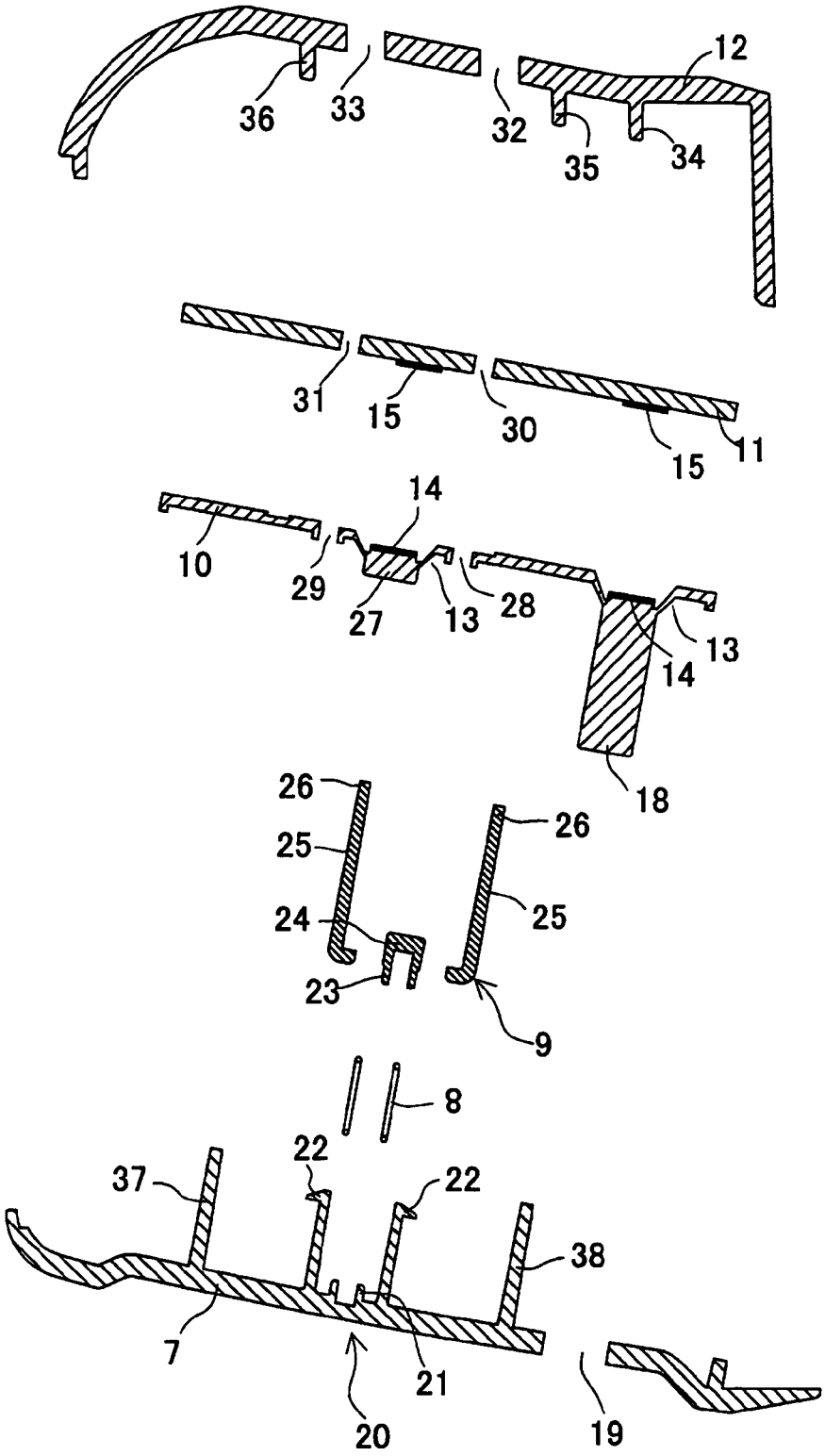
FIG. 5 is an exploded view of the operating panel to show a sequence of assembly of the operating panel according to the first illustrative embodiment.

Next, structures of the keyswitches 5 and the opening/closing detection switch 17 will be described in detail with reference to FIGS. 4A, 4B, and 5. FIG. 5 shows the sequence of assembly of the operating panel 4, so that the operating panel 4 is shown upside down in the drawing. As shown in FIGS. 4A, 4B, and 5, a keyswitch 5 includes a switching portion 16 that may be implemented by which a rubber spring 13 made of, for example, silicone rubber, having a traveling contact 14, may be disposed at a position opposite to a corresponding fixed contact 15 of the circuit board 11 provided with the number of fixed contacts 15 thereon. The keyswitch 5 further includes a head portion 18 at the rubber spring 13. The rubber spring 13 generally protrudes upward through a guide hole 19 provided in the operating panel cover 7 such that its head portion 18 projects above a surface of the operating panel cover 7. In the same manner, other rubber springs 13, each of which has a traveling contact 14 and a head portion 18, are disposed at positions opposite to the other corresponding fixed contacts 15 provided on the circuit board 11. By this structure, the number of keyswitches 5 are provided. Some of the head portions 18 of the rubber springs 13 have characters, letters, or symbols indicated or displayed on their tops. As described above, the rubber springs 13 are continuous with each other to form the rubber spring sheet 10.

The opening/closing detection switch 17 may be implemented by a keyswitch 5 having a head portion 27 that may be shorter than the head portions 18 of the keyswitches 5 structured as described above. As shown in FIG. 3, the fixed contacts 15 of the circuit board 11 and the rubber springs 13 of the rubber spring sheet 10 are divided into blocks by function. Thus, the opening/closing detection switch 17 may be formed in the empty space left between the blocks at the same time when the circuit board 11 and the rubber spring sheet 10 are formed. As a result, no additional cost may be incurred.

As described above, because the opening/closing detection switch 17 has the head portion 27 that may be shorter than the head portions 18 of the other keyswitches 5, the head portion 27 of the opening/closing detection switch 17 does not project above the surface of the operating panel cover 7. When the first cover member 3 is opened with respect to the second cover member 2 as shown in FIG. 2, a base portion 24 of the actuator 9, which is supported, via a spring 8, by a support portion 20 provided at the operating panel cover 7, contacts and presses the head portion 27 of the rubber spring 13 of the opening/closing detection switch 17 by an urging force of the spring 8 as shown in FIG. 4A. In this state, the traveling contact 14 may be in contact with the fixed contact 15 in the opening/closing detection switch 17, so that it can be detected that the first cover member 3 is located at the uncovering position B. The actuator 9 includes two extended portions 25 which extend from both ends of the base portion 24 and each of which has a tip portion 26. When the first cover member 3 is located at the uncovering position B, the tip portions 26 of the extended portions 25 pass through holes 28, 29 provided in the rubber spring sheet 10, through holes 30, 31 provided in the circuit board 11, and through holes 32, 33 provided in the first cover 12, respectively, and protrude below the first cover 12. When the first cover member 3 is closed with respect to the second cover member 2 as shown in FIG. 1, a second cover 39 upwardly pushes the tips portions 26 of the actuator 9 against the urging force of the spring 8, so that the base portion 24 of the actuator 9 may be separated from the head portion 27 and the rubber spring 13 returns to its original state. Thus, the traveling contact 14 may be separated from the fixed contact 15 in the opening/closing detection switch 17, so that it can be detected that the first cover member 3 is located at the covering position A with respect to the second cover member 2.

Referring to FIG. 5, the sequence of assembly of the operating panel 4 including the keyswitches 5 and the opening/closing detection switch 17 will be described. First, the operating panel cover 7 may be placed upside down. Next, one end of the spring 8 may be fitted to a boss 21 provided in the support portion 20 of the operating panel cover 7. Then, while a boss 23 provided at the base portion 24 of the actuator 9 may be inserted into another end of the spring 8, the actuator 9 may be downwardly pressed toward the operating panel cover 7 until the actuator 9 is elastically caught or supported by a hook 22 of the support portion 20. When the actuator 9 is caught by the support portion 20, the actuator 9 may be pressed upward in FIG. 5 by the urging force of the spring 8, so that the actuator 9 is contacted with and is caught by the hook 22. Therefore, the actuator 9 does not come off from the support portion 20. Then, the rubber spring sheet 10 may be placed on bosses 37, 38 extending from the operating panel cover 7 such that the tip portions 26 of the extended portions 25 extending from the both ends of the base portion 24 of the actuator 9 pass through the through holes 28, 29 of the rubber spring sheet 10 and the head portions 18 of the rubber springs 13 are inserted into the respective guide holes 19 of the operating panel cover 7. Although a number of guide holes 29 and a number of bosses 37, 38 are provided at the operating panel cover 7 in actual, FIG. 5 shows only each one of the guide holes 29 and bosses 37, 38. In the state where the rubber spring sheet 10 may be placed on the bosses 37, 38 as described above, the head portion 27 of the rubber spring 13 of the opening/closing detection switch 17 of the rubber spring sheet 10 is in contact with the base portion 24 of the actuator 9 because the base portion 24 of the actuator 9 is located at an upper position by the urging force of the spring 8. Next, the circuit board 11 may be placed over the rubber spring sheet 10 such that the tip portions 26 of the extended portions 25 of the actuator 9 pass through the through holes 30, 31 of the circuit board 11. In this state, the circuit board 11 and the rubber spring sheet 10 are fixed to the operating panel cover 7 by a hook (not shown) extending from the operating panel cover 7. Then, the first cover 12 may be placed on the circuit board 11 such that the tip portions 26 of the extended portions 25 of the actuator 9 protruding from the through holes 30, 31 of the circuit board 11 pass through the through holes 32, 33 of the first cover 12. Finally, the operating panel cover 7 may be fixed to the first cover 12 by which a boss (not shown) extending from the operating panel cover 7 may be secured by a screw (not shown) from the underside of the first cover 12. Then, the image reader and other related-parts are mounted to the first cover 12 assembled as described above, and the first cover member 3 is completed. The completed first cover member 3 may be then attached to the second cover member 2 so as to be capable of opening and closing with respect to the second cover member 2 as shown in FIGS. 1, 2, 4A, and 4B. In this state, the first cover member 3 may be disposed while being turned upside down from the state of FIG. 5, so that the circuit board 11 is supported by supporting ribs 34, 35, 36 of the first cover 12 in the first cover member 3.

Referring to FIGS. 1, 2, 4A, and 4B, operation of the keyswitches 5 and the opening/closing detection switch 17 will be described. First, the operation of the keyswitches 5, except the keyswitch 5 for the opening/closing detection switch 17, will be described. All the keyswitches 5, except the keyswitch 5 for the opening/closing detection switch 17, function in the same manner, so that the description will be made on one of the keyswitches 5 only. The keyswitch 5 may be in an off state unless its head portion 18 is not pressed down by the user because the fixed contact 15 of the circuit board 11 and the traveling contact 14 of the rubber spring 13 are separated from each other as shown in FIGS. 4A and 4B. When the head portion 18 of the keyswitch 5 is pressed down by the user, the fixed contact 15 and the traveling contact 14 are contacted with each other and the keyswitch 5 becomes an on state. At that time, data indicating a function assigned to the pressed keyswitch 5 may be inputted. Next, the operation of the opening/closing detection switch 17 will be described. While the information apparatus 1 is normally used, as shown in FIG. 1, the first cover member 3 may be located at the covering position A to close the opening 2*a* of the second cover member 2. Under this conditions, the state of the opening/closing detection switch 17 may be as shown in FIG. 4B. That is, the second cover 39 upwardly pushes the tip portions 26 of the extended portions 25 extending from the both ends of the base portion 24 of the actuator 9 against the urging force of the spring 8, so that there is clearance created between the base portion 24 of the actuator 9 and the head portion 27 of the rubber spring 13 and the rubber spring 13 returns to its original state on its own. Therefore, the fixed contact 15 of the circuit board 11 and the traveling contact 14 of the rubber spring 13 are separated from each other, so that the opening/closing detection switch 17 is in the off state. A controller (not shown) determines the off state of the opening/closing detection switch 17 as that the first cover member 3 is closed with respect to the second cover member 2. When the user needs to perform an operation in the second cover member 2, for example, when a paper jam occurred in the information apparatus 1 or when an ink cartridge needs to be replaced with a new one, the user performs an appropriate operation in the second cover member 2 while the opening 2*a* of the second cover member 2 is opened by rotating the first cover member 3 to the uncovering position B from the covering position A. At that time, the state of the opening/closing detection switch 17 is as shown in FIG. 4A. That is, the tip portions 26 of the extended portions 25 of the base portion 24 of the actuator 9 are free from contact with the second cover 39, so that the head portion 27 of the rubber spring 13 is pressed down by the base portion 24 of the actuator 9 by the urging force of the spring 8. Accordingly, the fixed contact 15 of the circuit board 11 and the traveling contact 14 of the rubber spring 13 are contacted with each other, so that the opening/closing detection switch 17 is in the on state. The controller determines the on state of the opening/closing detection switch 17 as that the first cover member 3 is opened with respect to the second cover member 2, so that the controller takes safety measures to inform the user of the opening of the first cover member 3. The first cover member 3 may be located at the uncovering position B only during clearing of a jammed sheet or replacing of an ink cartridge with a new one, which may be an extremely short period of time as compared with the period during which the first cover member 3 is located at the covering position A. Accordingly, the creep deformation hardly develops in the rubber spring 13 of the opening/closing detection switch 17.

As described above, in the information apparatus 1 according to the first illustrative embodiment, the input device includes the number of keyswitches 5, each of which has the switching portion 16 including the circuit board 11 provided with the fixed contacts 15 and the rubber spring 13 having the traveling contact 14 which is capable of contacting and separating from the corresponding fixed contact 15. The rubber spring 13 is capable of being elastically deformed by pressure. The opening/closing detection switch 17 includes at least one of the number of keyswitches 5. With this structure, a special switch for detecting the opening and closing of the first cover member 3, a special harness for connecting the special switch, and the prevention measures for noise, which is to be caused by the provision of the special harness, can be eliminated. In addition, assembly costs for those parts and a cost for fine adjustment for positioning those parts can be reduced. Further, the fixed contacts 15 of the circuit board 11 and the rubber springs 13 are divided into blocks by function, so that the opening/closing detection switch 17 for detecting the opening and closing of the first cover member 3 can be provided in the empty space left between the blocks. Therefore, the circuit board 11 and the rubber spring sheet 10 can be obtained at the same cost as usual, that is, no additional cost is incurred. The rubber spring 13 of the opening/closing detection switch 17 may be maintained in the off state during use of the information apparatus 1, so that the creep deformation can be prevented from developing in the rubber spring 13 of the opening/closing detection switch 17.

In the information apparatus 1 according to the first illustrative embodiment, the opening/closing detection switch 17 includes the spring 8, which applies the pressure to the rubber spring 13 of the opening/closing detection switch 17 at all times, and the actuator 9, which releases the pressure applied to the rubber spring 13 by the spring 8. When the first cover member 3 is closed with respect to the second cover member 2, the actuator 9 releases the pressure applied to the rubber spring 13 by the spring 8. During use of the information apparatus 1, the first cover member 3 may be closed with respect to the second cover member 2. As described above, the pressure applied to the rubber spring 13 by the spring 8 may be released by the actuator 9 while the first cover member 3 is closed, so that the creep deformation can be prevented from developing in the rubber spring 13 of the opening/closing detection switch 17.

In addition, in the opening/closing detection switch 17, the actuator 9 includes the base portion 24, which is disposed between the rubber spring 13 and the spring 8 and may be capable of pressing the rubber spring 13, and the extended portions 25, which extend from the both ends of the base portion 24 and pass through the through holes 28 to 33 provided in the rubber spring sheet 10, the circuit board 11 and the first cover member 3. When the first cover member 3 is closed with respect to the second cover member 2, the tip portions 26 of the extended portion 25 are contacted with the second cover member 2 and the base portion 24 of the actuator 9 may be separated from the rubber spring 13 against the urging force of the spring 8, so that the pressure applied to the rubber spring 13 is released. During use of the information apparatus 1, the first cover member 3 may be closed with respect to the second cover member 2. As described above, the pressure applied to the rubber spring 13 by the spring 8 may be released by the actuator 9 while the first cover member 3 is closed, so that the creep deformation can be prevented from developing in the rubber spring 13 of the opening/closing detection switch 17. The flat area of the second cover member 2 can receive the tip portions 26 of the extended portions 25 of the base portion 24 at any position, so that it is not necessary to perform fine adjustment to position the actuator 9 and the second cover member 2. The opening/closing detection switch 17 can be provided at any position within the input device, so that design of the information apparatus 1 is not limited. In addition, the switching function of the opening/closing detection switch 17 is implemented in the operating panel 4, so that the assembly of the information apparatus 1 can be facilitated.

Next, a second illustrative embodiment of the disclosure will be described with reference to FIGS. 6 to 10. In a compact facsimile machine, a copying machine, and an image reader, generally, a document may be read at a fixed image reading portion while being conveyed under an operating panel. Therefore, in such a device, an opening/closing detection switch needs to be disposed at a position where the opening/closing detection switch does not interfere with the conveyance of documents. Therefore, an information apparatus 101 according to the second illustrative embodiment includes an operating panel 104 provided with an opening/closing detection switch 117 at an end portion of an operating panel cover 107 so as not to interfere with the conveyance of documents.

Figure 6:
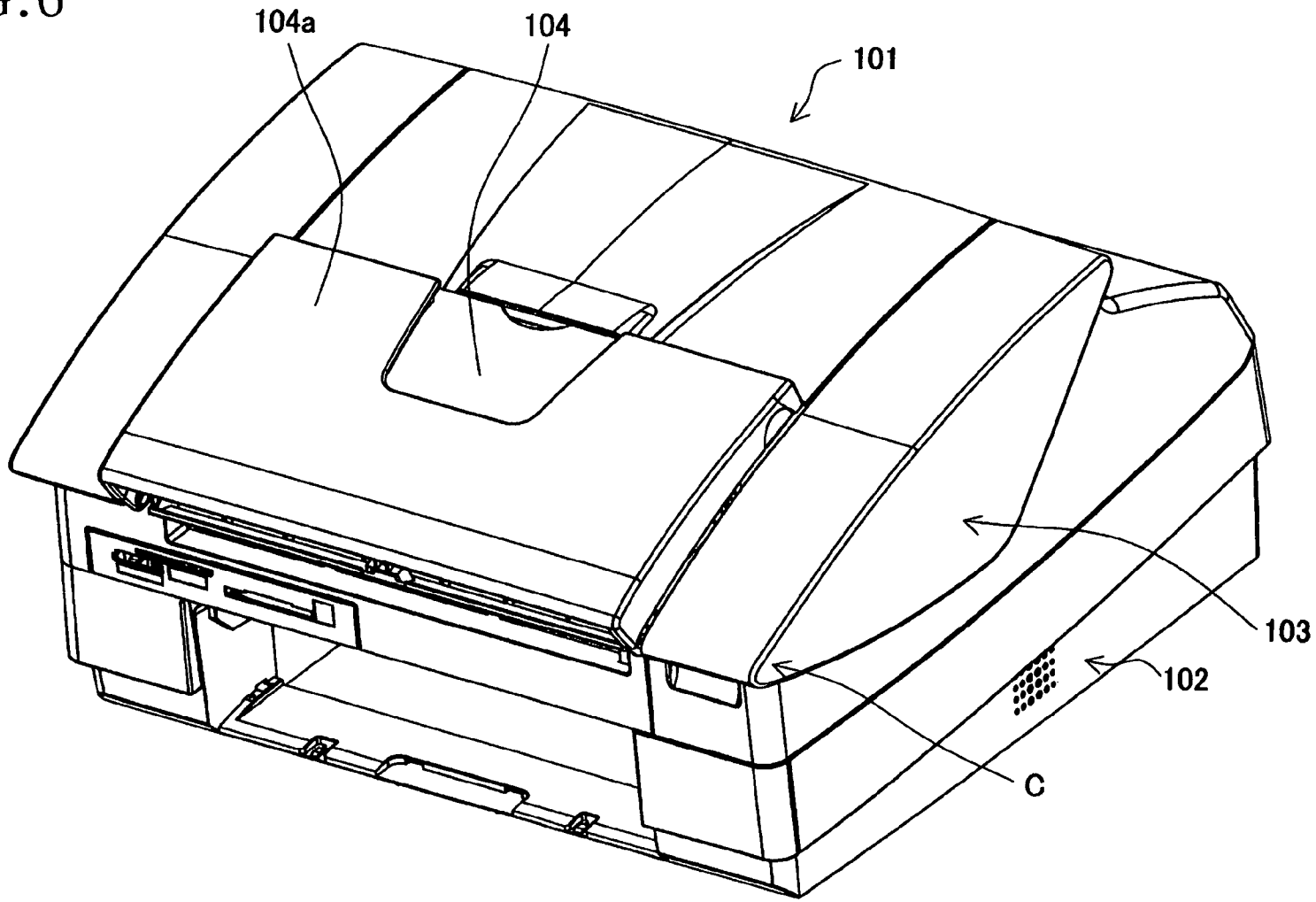
FIG. 6 is a perspective view of an information apparatus according to a second illustrative embodiment of the disclosure.
Figure 7:
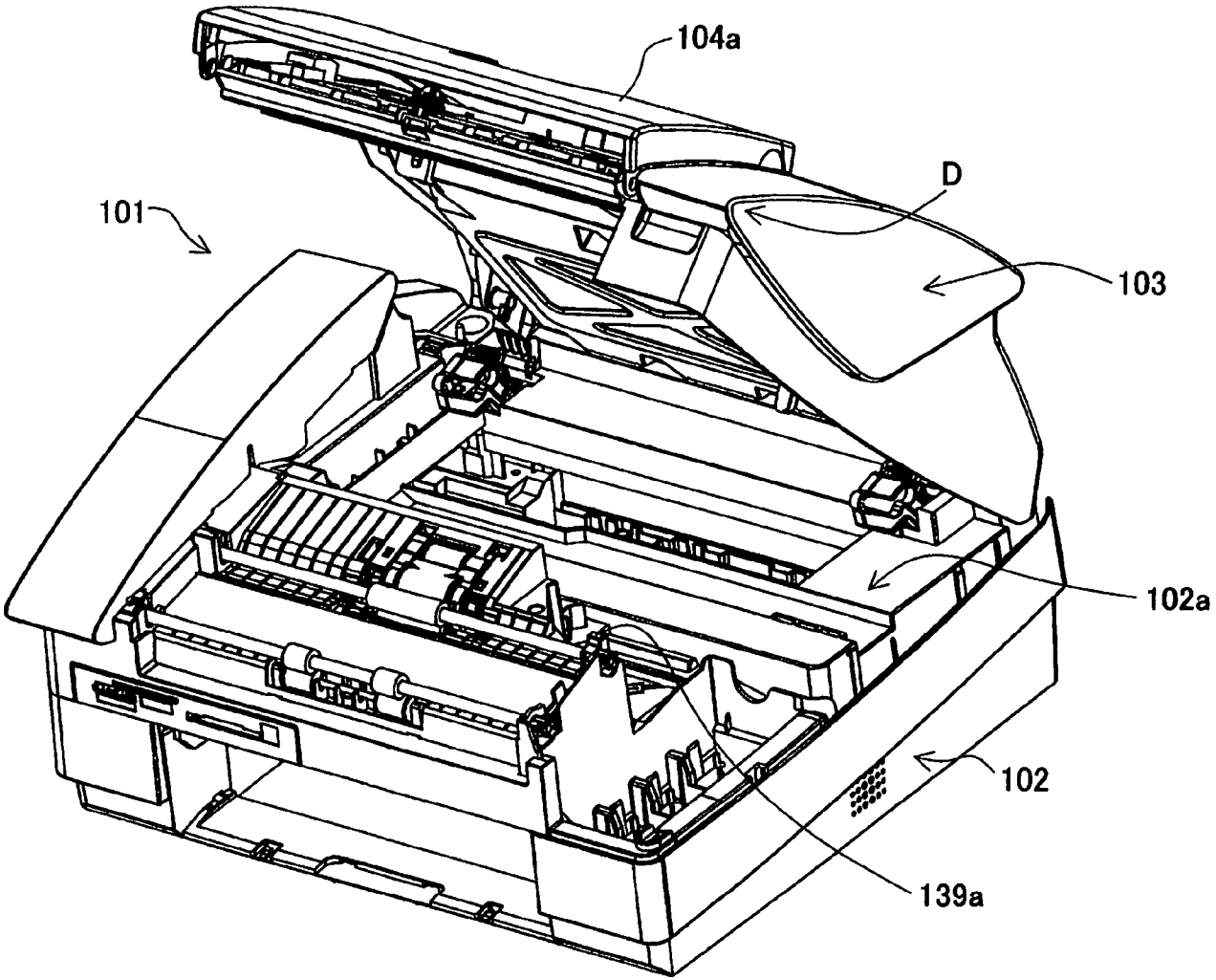
FIG. 7 is a perspective view of the information apparatus of FIG. 6 with a first cover member is opened from the front in accordance with aspects of the present invention.

As shown in FIGS. 6 and 7, the information apparatus 101 has a clamshell structure in which a first cover member 103 and a second cover member 102 (functioning as a housing) are connected with each other at their one ends such that the first cover member 103 opened and closed with respect to the second cover member 102. That is, the first cover member 103 may be capable of pivoting up and down about its one end between a covering position C (FIG. 6) where the first cover member 103 covers the second cover member 102 to close an opening 102*a* and an uncovering position D (FIG. 7) where the first cover member 103 is separated from the second cover member 102 to reveal the opening 102*a*. While the information apparatus 101 is normally used, the first cover member 103 may be located at the covering position C to cover the opening 102*a* of the second cover member 102. When a user needs to perform an operation in the second cover member 102, for example, when a paper jam occurred in the second cover member 102 needs to be cleared or when an ink cartridge needs to be replaced with a new one, the user performs an appropriate operation in the second cover member 102 while the opening 102*a* of the second cover member 102 is opened by rotating the first cover member 103 to the uncovering position D from the covering position C. The operating panel 104 may be covered with an operating panel cover 104*a* when the information apparatus 101 is not used.

Figure 8:
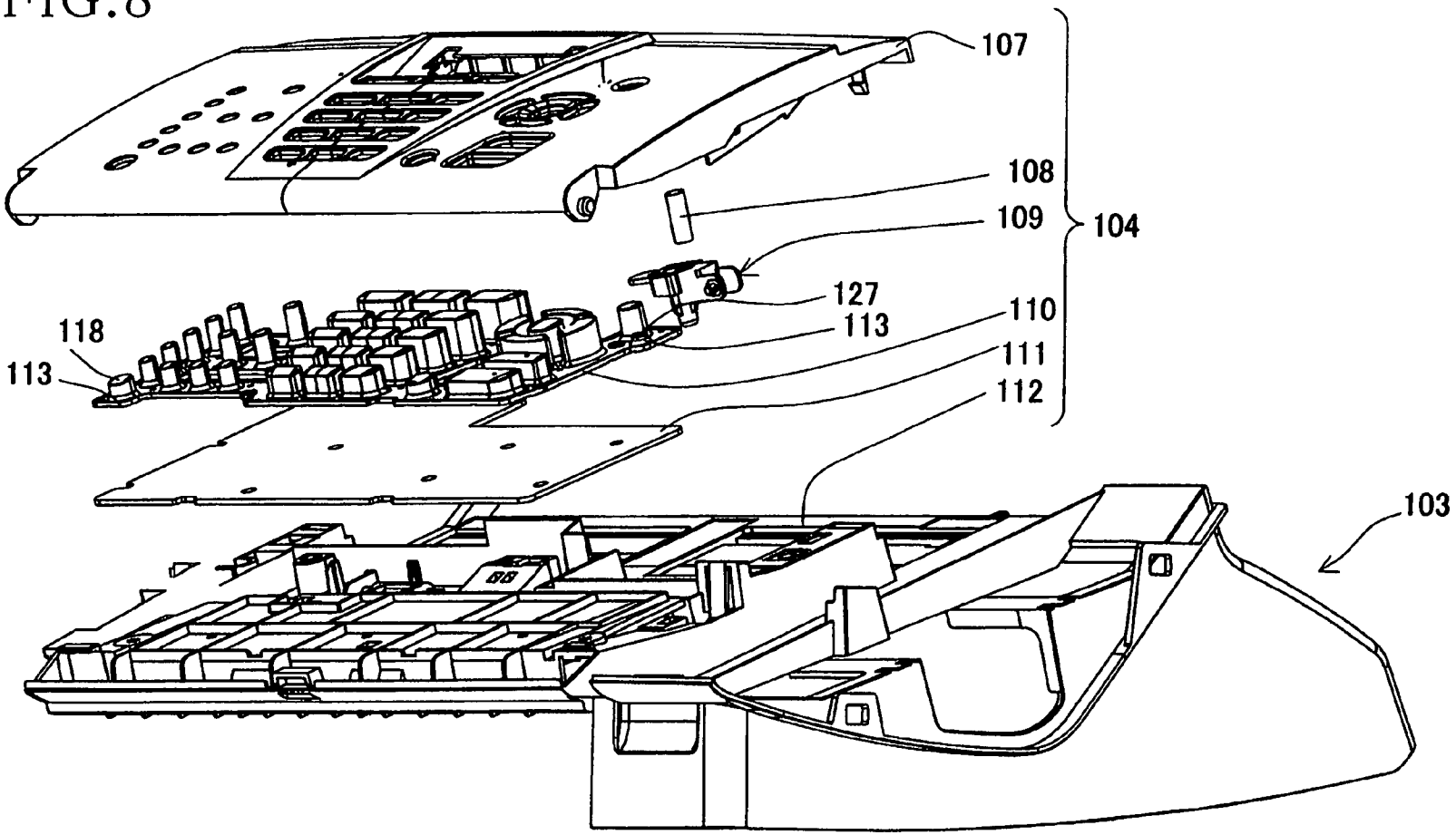
FIG. 8 is an exploded view of an operating panel provided to a first cover member according to the second illustrative embodiment.
Figure 9A:
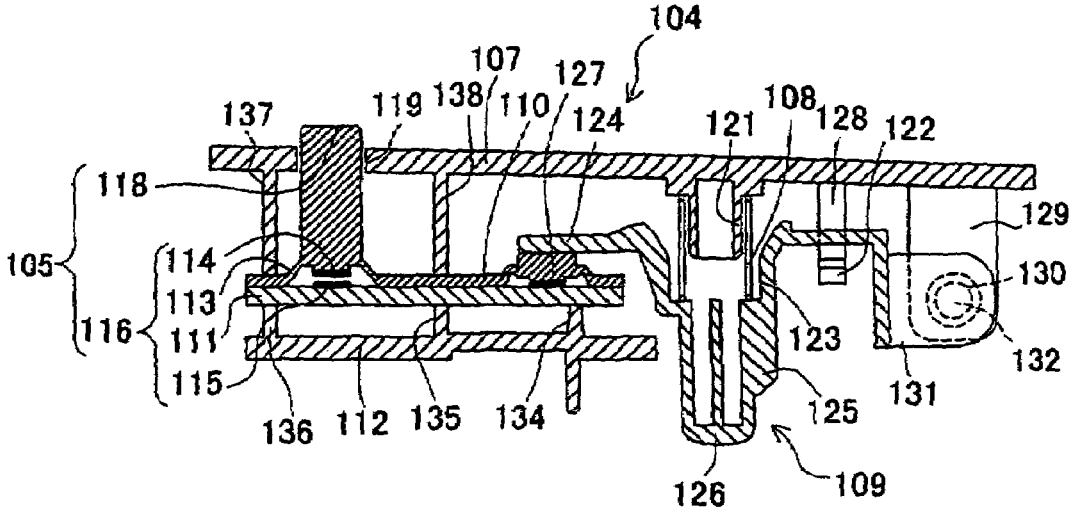
FIG. 9A is a sectional view of the operating panel provided with a number of keyswitches and an opening/closing detection switch according to the second illustrative embodiment, wherein the first cover member is opened and the opening/closing detection switch is in an on state.
Figure 9B:
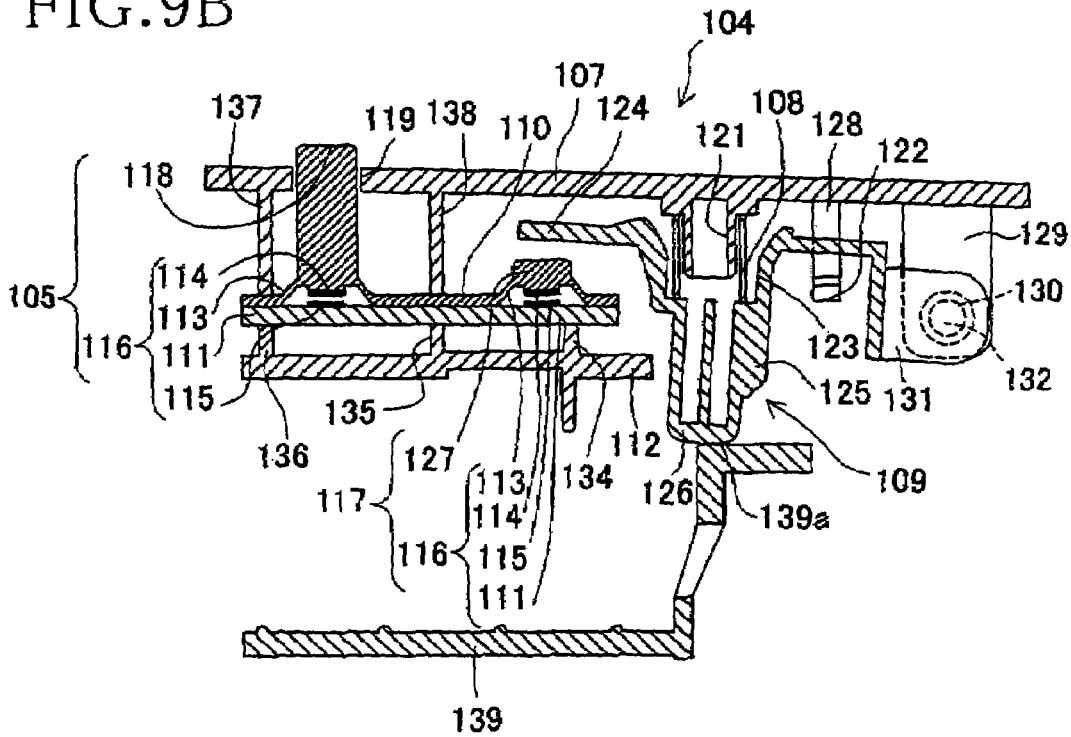
FIG. 9B is the sectional view of the operating panel provided with the number of keyswitches and the opening/closing detection switch according to the second illustrative embodiment, wherein the first cover member is closed and the opening/closing detection switch is in an off state.

Next, a structure of the operating panel 104 will be described with reference to FIG. 8. As shown in FIG. 8, the operating panel 104 includes the operating panel cover 107, a first cover 112, a circuit board 111, and a rubber spring sheet 110. The operating panel cover 107 and the first cover 112 sandwich the circuit board 111 and the rubber spring sheet 110 therebetween while the rubber spring sheet 110 is disposed above the circuit board 111. The circuit board 111 may be provided with a number of fixed contacts 115 (FIGS. 9A and 9B). The rubber spring sheet 110 includes a number of rubber springs 113 which are integral with and continuous with each other and each of which has a traveling contact 114 and a head portion 118. The number of keyswitches 105 (FIGS. 9A and 9B) are implemented by a combination of the circuit board 111 and the rubber spring sheet 110. In order to use one of the number of keyswitches 105 as the opening/closing detection switch 117, an actuator 109 (functioning as a release member) and a spring 108 (functioning as an urging member) are provided so as to be sandwiched between the operating panel cover 107 and the first cover 112.

Figure 10:
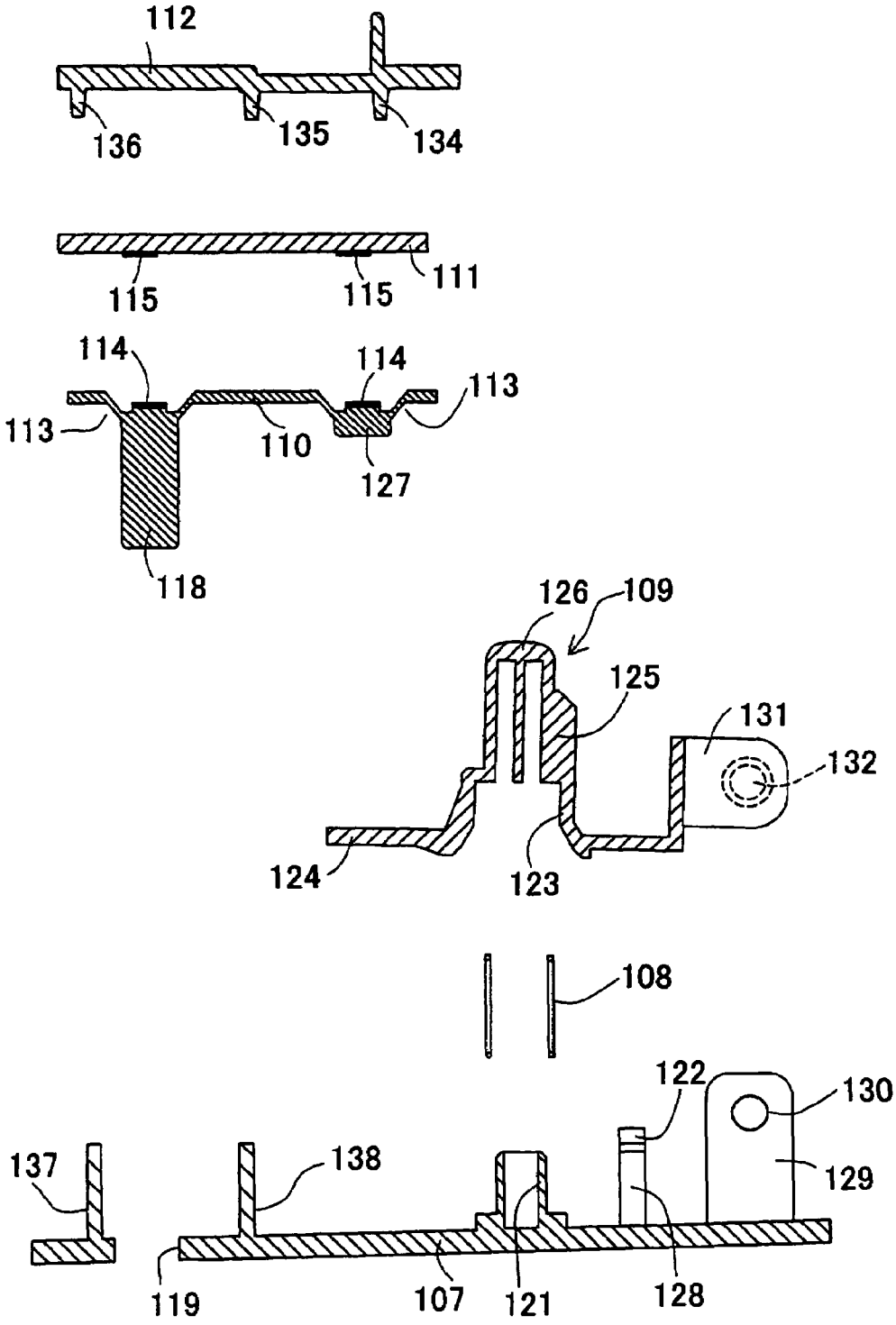
FIG. 10 is an exploded view of the operating panel to show a sequence of assembly of the operating panel according to the second illustrative embodiment.

Next, structures of the keyswitches 105 and the opening/closing detection switch 117 will be described in detail with reference to FIGS. 9A, 9B, and 10. FIG. 10 shows the sequence of assembly of the operating panel 104, so that the operating panel 104 is indicated upside down in the drawing. As shown in FIGS. 9A, 9B, and 10, a keyswitch 105 includes a switching portion 116 that is implemented by which a rubber spring 113 made of, for example, silicone rubber, having a traveling contact 114, may be disposed at a position opposite to a corresponding fixed contact 115 of the circuit board 111 provided with a number of fixed contacts 115 thereon. The keyswitch 105 further includes a head portion 118 at the rubber spring 113. The rubber spring 113 generally protrudes upward through a guide hole 119 provided in the operating panel cover 107 such that its head portion 118 projects above a surface of the operating panel cover 107. In the same manner, other rubber springs 113, each of which has a traveling contact 114 and a head portion 118, are disposed at positions opposite to the other corresponding fixed contacts 115 provided on the circuit board 111. By this structure, the number of keyswitches 105 are provided. Some of the head portions 118 of the rubber springs 113 have characters, letters, or symbols indicated or displayed on their tops. As described above, the rubber springs 113 are continuous with each other to form the rubber spring sheet 110.

The opening/closing detection switch 117 may be implemented by a keyswitch 105 having a head portion 127 that is shorter than the head portions 118 of the keyswitches 105 structured as described above. As shown in FIG. 8, the fixed contacts 115 and the circuit board 111 and the rubber springs 113 of the rubber spring sheet 110 are divided into blocks by function. Thus, the opening/closing detection switch 117 may be provided in the empty space left between the blocks at the same time when the circuit board 111 and the rubber spring sheet 110 are formed. As a result, no additional cost is incurred.

As described above, because the opening/closing detection switch 117 has the head portion 127 that may be shorter than the head portions 118 of the keyswitches 105, the head portion 127 of the opening/closing detection switch 117 does not project above the surface of the operating panel cover 107. When the first cover member 103 is opened with respect to the second cover member 102 as shown in FIG. 7, a pressing portion 124 of the actuator 109 may be contacted with the head portion 127 of the opening/closing detection switch 117 to press the rubber spring 113 by the urging force of the spring 108 as shown in FIG. 9A. The actuator 109 may be rotatably supported at a rotation support portion 129 provided at the operating panel cover 107 via a rotation support pin 132 of a rotation support end 131 of the actuator 109. The spring 108 may be provided so as to extend between a spring support portion 121 of the operating panel cover 107 and a spring accommodating portion 123 of the actuator 109. With this structure, the traveling contact 114 and the fixed contact 115 are contacted with each other in the opening/closing detection switch 117, so that it can be detected that the first cover member 103 is located at the uncovering position D with respect to the second cover member 102. The actuator 109 includes a projecting portion 125 having a tip portion 126 at its bottom. When the first cover member 103 is located at the uncovering position D, the tip portion 126 of the projecting portion 125 of the actuator 109 may be located at the position separated from the circuit board 111 and functions as an end portion of the operating panel cover 107. When the first cover member 103 is closed with respect to the second cover member 102 as shown in FIG. 6, a pressing portion 139*a* of the second cover member 102 upwardly pushes the tip portion 126 of the projecting portion 125 of the actuator 109 against the urging force of the spring 108, so that the pressing portion 124 of the actuator 109 may be separated from the head portion 127 of the opening/closing detection switch 117 and the rubber spring 113 returns to its original state as shown in FIG. 9B. In accordance with this, the traveling contact 114 may be separated from the fixed contact 115 in the opening/closing detection switch 117, so that it can be detected that the first cover member 103 is located at the covering position C with respect to the second cover member 102.

Referring to FIG. 10, the sequence of assembly of the operating panel 104 including the keyswitches 105 and the opening/closing detection switch 117 will be described. First, the operating panel cover 107 may be placed upside down. Next, the rotation support pin 132 provided at the rotation support end 131 of the actuator 109 may be fitted to a support hole 130 provided in the rotation support portion 129 extending from the operating panel cover 107 to attach the actuator 109 to the rotation support portion 129. Then, one end of the spring 108 may be fitted to the spring support portion 121 provided at the operating panel cover 107. Then, while another end of the spring 108 is inserted into the spring accommodating portion 123 of the actuator 109, the actuator 109 may be downwardly pressed toward the operating panel cover 107 until the actuator 109 is elastically caught or supported by a hook 122 of an extended portion 128 extending from the operating panel cover 107. When the actuator 109 is caught by the hook 122 of the extended portion 128, the actuator 109 may be pressed upward in FIG. 10 by the urging force of the spring 108, so that the actuator 109 is contacted with and is caught by the hook 122. Therefore, the actuator 109 does not come off from the extended portion 128. Then, the rubber spring sheet 110 may be placed on bosses 137, 138 extending from the operating panel cover 107 such that the head portions 118 of the rubber springs 113 are inserted into guide holes 119 of the operating panel cover 107 and the head portion 127 of the rubber spring 113 is positioned above the pressing portion 124 of the actuator 109. Although a number of guide holes 119 and a number of bosses 137, 138 are provided at the operating panel cover 107 in actual, FIG. 10 shows only each one of the guide holes 119 and bosses 137, 138. Next, the circuit board 111 may be placed over the rubber spring sheet 110 such that the fixed contacts 115 of the circuit board 111 face the respective corresponding traveling contacts 114 of the rubber springs 113. Then, the circuit board 111 and the rubber spring sheet 110 are fixed to the operating panel cover 107 by a hook (not shown) extending from the operating panel cover 107. Next, the first cover 112 may be placed on the circuit board 111 such that the tip portion 126 of the projecting portion 125 of the actuator 109 functions as the end portion of the operating panel cover 107 at the position separated from the circuit board 111 and protrudes from a surface of the first cover 112 which is not the operating panel cover 107 side. Finally, the operating panel cover 107 may be fixed to the first cover 112 by which a boss (not shown) extending from the operating panel cover 107 is secured by a screw (not shown) from the underside of the first cover 112. As shown in FIGS. 9A and 9B, when the operating panel 104 is turned upside down from the state of FIG. 8, the circuit board 111 may be supported by supporting ribs 134, 135, 136 of the first cover 112. Other related-parts are then mounted to the first cover 112 assembled as described above and the first cover member 103 may be completed. Then, the first cover member 103 may be attached to the second cover member 102 so as to be capable of opening and closing with respect to the second cover member 102.

Referring to FIGS. 6, 7, 9A, and 9B, operation of the keyswitches 105 and the opening/closing detection switch 117 will be described. First, the operation of the keyswitches 105, except the keyswitch 105 for the opening/closing detection switch 117, will be described. All the keyswitches 105, except the keyswitch 105 for the opening/closing detection switch 117, function in the same manner, so that the description will be made on one of the keyswitches 105 only. The keyswitch 105 may be in an off state unless its head portion 118 is not pressed down by the user because the fixed contact 115 of the circuit board 111 and the traveling contact 114 of the rubber spring 113 are separated from each other as shown in FIGS. 9A and 9B. When the head portion 118 of the keyswitch 105 is pressed down by the user, the fixed contact 115 and the traveling contact 114 are contacted with each other and the keyswitch 105 becomes an on state. At that time, data indicating a function assigned to the pressed keyswitch 105 is inputted. Next, the operation of the opening/closing detection switch 117 will be described. When the information apparatus 101 may be normally used, as shown in FIG. 6, the first cover member 103 may be located at the covering position C to close the opening 102*a* of the second cover member 102. Under this conditions, the state of the opening/closing detection switch 117 may be as shown in FIG. 9B. That is, the surface of the pressing portion 139*a* provided at the second cover 139 of the second cover member 102 upwardly pushes the tip portion 126 of the projecting portion 125 of the actuator 109 against the urging force of the spring 108, so that there is clearance created between the pressing portion 124 of the actuator 109 and the head portion 127 of the rubber spring 113 and the rubber spring 113 returns to its original state on its own. Therefore, the fixed contact 115 of the circuit board 111 and the traveling contact 114 of the rubber spring 113 are separated from each other, so that the opening/closing detection switch 117 becomes the off state. A controller (not shown) determines the off state of the opening/closing detection switch 117 as that the first cover member 103 is closed with respect to the second cover member 102. When the user needs to perform an operation in the second cover member 102, for example, when a paper jam occurred in the information apparatus 101 or when an ink cartridge needs to be replaced with a new one, the user performs an appropriate operation in the second cover member 102 while the opening 102*a* of the second cover member 102 is opened by rotating the first cover member 103 to the uncovering position D from the covering position C as shown in FIG. 7. At that time, the state of the opening/closing detection switch 117 may be as shown in FIG. 9A. That is, the tip portion 126 of the projecting portion 125 of the actuator 109 may be free from contact with the second cover 139, so that the head portion 127 of the rubber spring 113 may be pressed down by the pressing portion 124 of the actuator 109 by the urging force of the spring 108. Accordingly, the fixed contact 115 of the circuit board 111 and the traveling contact 114 of the rubber spring 113 are contacted with each other, so that the opening/closing detection switch 117 is in the on state. The controller determines the on state of the opening/closing detection switch 117 as that the first cover member 103 is opened with respect to the second cover member 102, so that the controller takes safety measures to inform the user of the opening of the first cover member 103. The first cover member 103 may be located at the uncovering position D only during clearing of a jammed sheet or replacing of an ink cartridge with a new one, which is an extremely short period of time as compared with the period during which the first cover member 103 is located at the covering position C. Accordingly, the creep deformation hardly develops in the rubber spring 113 of the opening/closing detection switch 117.

As described above, in the information apparatus 101 according to the second illustrative embodiment, the release member includes the actuator 109 in which its one end is rotatably supported in the first cover member 103, another end includes the pressing portion 124 capable of applying the pressure to the rubber spring 113 of the opening/closing detection switch 117, and the projecting portion 125 is provided between the ends of the actuator 109. When the first cover member 103 is closed with respect to the second cover member 102, the tip portion 126 of the projecting portion 125 is contacted with the second cover member 102 and the pressing portion 124 is separated from the rubber spring 113 against the pressure of the spring 108, thereby releasing the pressure applied to the rubber spring 113 in the opening/closing detection switch 117. During use of the information apparatus 101, the first cover member 103 may be closed with respect to the second cover member 102. As described above, the pressure applied to the rubber spring 113 by the spring 108 may be released by the actuator 109 while the first cover member 103 is closed, so that the creep deformation can be prevented from developing in the rubber spring 113 of the opening/closing detection switch 117. The second cover member 102 can receive the tip portion 126 of the projecting portion 125 at any position, so that it is not necessary to perform fine adjustment to position the actuator 109 and the second cover member 102. In addition, the switching function of the opening/closing detection switch 117 is implemented in the operating panel 104, so that the assembly of the information apparatus 101 can be facilitated. Further, the opening/closing detection switch 117 can be located at the end portion of the first cover member 103, so that the conveyance of documents is not interfered when the documents pass under the operating panel 104 through which data is inputted. The rubber spring 113 of the opening/closing detection switch 117 may be maintained in the off state during use of the information apparatus 101, so that the creep deformation can be prevented from developing in the rubber spring 113 of the opening/closing detection switch 117.

Figure 11A:
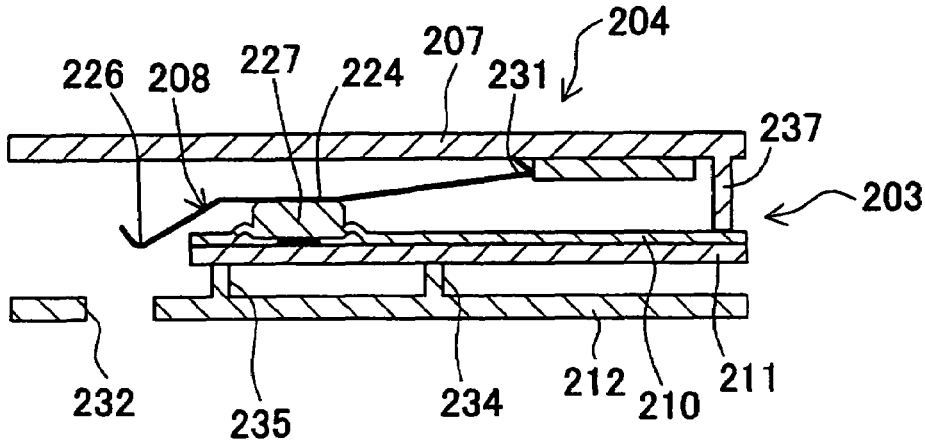
FIG. 11A is a sectional view of an operating panel provided with an opening/closing detection switch according to a third illustrative embodiment, wherein a first cover member is opened and the opening/closing detection switch is in an on state.
Figure 11B:
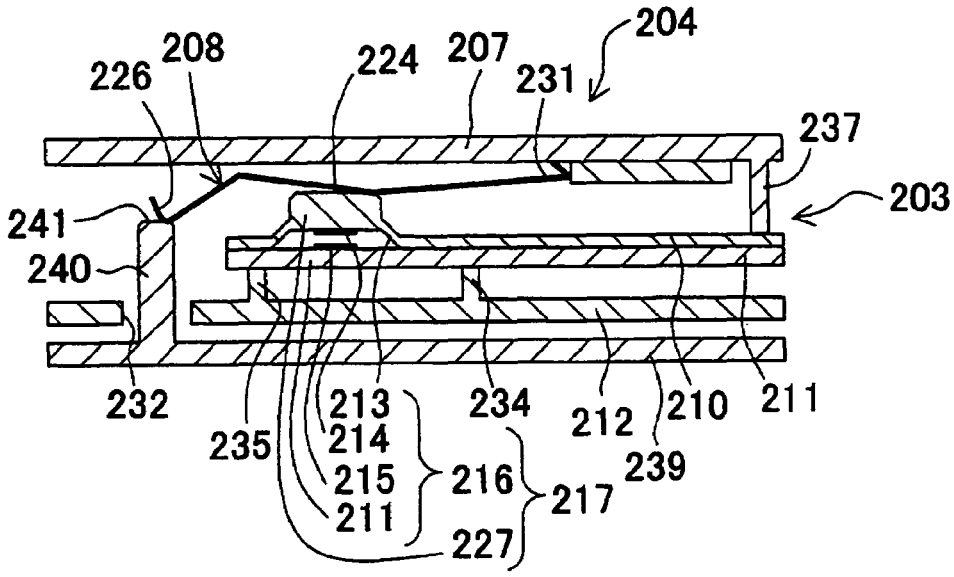
FIG. 11B is a sectional view of the operating panel provided with the opening/closing detection switch according to the third illustrative embodiment, wherein the first cover member is closed and the opening/closing detection switch is in an off state.

A third illustrative embodiment of the disclosure will be described with reference to FIGS. 11A and 11B. An information apparatus of the third illustrative embodiment has a structure similar to the information apparatus 1 of the first illustrative embodiment. Therefore, the same parts are designated with the similar numerals and explanations for those parts will be omitted. There may be a difference between the first illustrative embodiment and the third illustrative embodiment in the structure of the opening/closing detection switches. Hereinafter, an opening/closing detection switch 217 of the third illustrative embodiment will be described.

First, a structure of the opening/closing detection switch 217 will be described. The opening/closing detection switch 217 includes a switching portion 216 and a head portion 227. The switching portion 216 includes one of a number of fixed contacts 215 provided on a circuit board 211 and one of a number of rubber springs 213 each of which has a traveling contact 214 provided on a rubber spring sheet 210. A leaf spring 208 (functioning as an elastic member) is provided such that its one end (a fixed end) 231 is fixed to an operating panel cover 207 and another end 226 functions as a free end. The leaf spring 208 includes a rubber spring pressing portion 224 between the fixed end 231 and the free end 226. When a first cover member 203 is opened with respect to a second cover member (not shown), as shown in FIG. 11A, the rubber spring pressing portion 224 of the leaf spring 208 presses the head portion 227 of the rubber spring 213 by an urging force of the leaf spring 208. Thus, the traveling contact 214 may be contacted with the fixed contact 215, so that it can be detected that the first cover member 203 is opened with respect to the second cover member. When the first cover member 203 is closed with respect to the second cover member, as shown in FIG. 11B, a tip portion 241 of a projecting portion 240 provided at a second cover 239 of a surface of the second cover member upwardly pushes the free end 226 of the leaf spring 208 against the urging force of the leaf spring 208, so that the rubber spring pressing portion 224 of the leaf spring 208 is separated from the head portion 227 of the opening/closing detection switch 217 and the rubber spring 213 returns to its original state. Thus, the traveling contact 215 may be separated from the fixed contact 214 in the opening/closing detection switch 117, so that it can be detected that the first cover member 203 is located at the covering position C with respect to the second cover member.

Next, operation of the opening/closing detection switch 217 will be described. When the first cover member 203 is closed with respect to the second cover member, the state of the opening/closing detection switch 217 is as shown in FIG. 11B. That is, the end portion 241 of the projecting portion 240 extending from the second cover 239 of the upper surface of the second cover member passes through a through hole 232 of the first cover 212 to upwardly push the free end 226 of the leaf spring 208 against the urging force of the leaf spring 208. Thus, there may be clearance created under the rubber spring pressing portion 224 (functioning as a pressing portion) of the leaf spring 208, so that the rubber spring 213 returns to its original state on its own. Therefore, the fixed contact 215 of the circuit board 221 and the traveling contact 214 of the rubber spring 213 are separated from each other, so that the opening/closing detection switch 217 becomes the off state. The controller determines the off state of the opening/closing detection switch 217 as that the first cover member 203 is closed with respect to the second cover member. When the user needs to perform an operation in the second cover member, for example, when a paper jam occurred in the information apparatus or when an ink cartridge needs to be replaced with a new one, the user performs an appropriate operation in the second cover member while the opening of the second cover member is opened by rotating the first cover member 203 to the uncovering position from the covering position. At that time, the state of the opening/closing detection switch 217 is as shown in FIG. 11A. That is, the free end 226 of the leaf spring 208 in the first cover member 203 may be free from contact with the tip portion 241 of the projecting portion 240, so that the head portion 227 of the rubber spring 213 is pressed by the rubber spring pressing portion 224 of the leaf sprint 280 by the urging force of the lead spring 208. Therefore, the fixed contact 215 of the circuit board 213 and the traveling contact 214 of the rubber spring 213 are contacted with each other, so that the opening/closing detection switch 217 is in the on state. The controller determines the on state of the opening/closing detection switch 217 as that the first cover member 203 is opened with respect to the second cover member, so that the controller takes safety measures to inform the user of the opening of the first cover member 203. The first cover member 203 may be located at the uncovering position only during clearing of a jammed sheet or replacing of an ink cartridge with a new one, which is an extremely short period of time as compared with the period during which the first cover member 203 is located at the covering position. Accordingly, the creep deformation hardly develops in the rubber spring 213 of the opening/closing detection switch 217.

As described above, in the information apparatus according to the third illustrative embodiment, the cantilever-like leaf spring 208 that always applies the pressing force to the rubber spring 213 of the opening/closing detection switch 217 is provided. The pressing force of the leaf spring 208 may be released while the tip portion 241 of the projecting portion 240 provided at the second cover 239 disposed under the first cover member 203 upwardly pushes the leaf spring 208 when the first cover member 203 is closed. Thus, the leaf spring 208 doubles as an actuator, so that parts count and cost can be reduced. In addition, the structure for detecting the opening and closing of the first cover member 203 becomes simplified, so that space can be saved and a compact design can be achieved in the information apparatus. Further, the reduction of the parts count can increase reliability of the information apparatus. Moreover, the rubber spring 213 of the opening/closing detection switch 217 may be maintained in the off state during normal use of the information apparatus (when the first cover member 213 is located at the covering position), so that the creep deformation can be prevented from developing in the rubber spring 213 of the opening/closing detection switch 217.

Figure 12A:
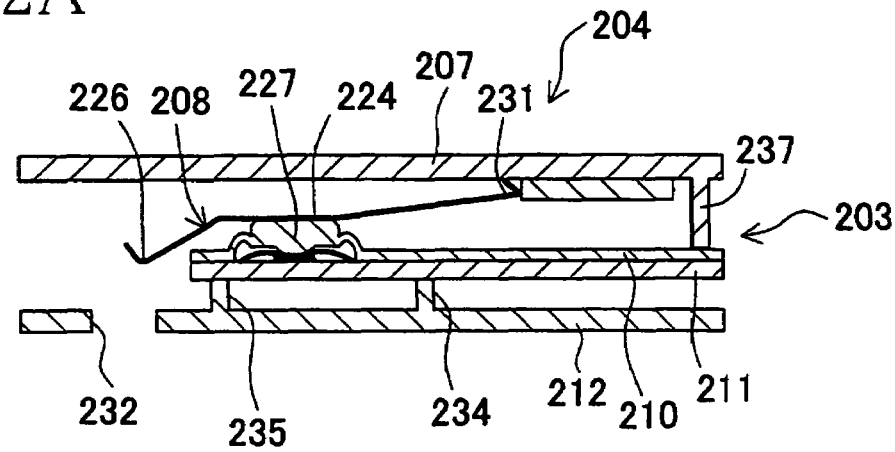
FIG. 12A is a sectional view of an operating panel provided with an opening/closing detection switch according to a fourth illustrative embodiment, wherein a first cover member is opened and the opening/closing detection switch is in an on state.
Figure 12B:
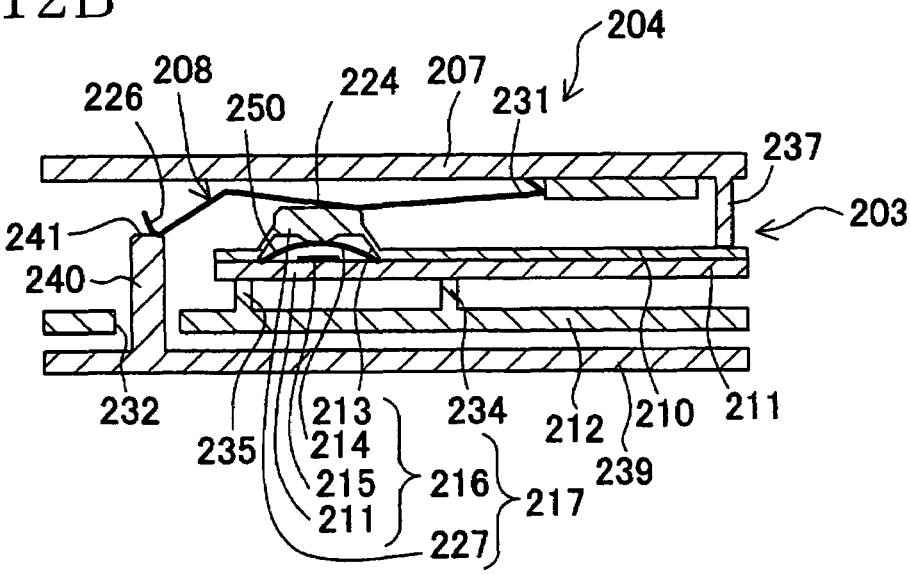
FIG. 12B is a sectional view of the operating panel provided with the opening/closing detection switch according to the fourth illustrative embodiment, wherein the first cover member is closed and the opening/closing detection switch is in an off state.

A fourth illustrative embodiment of the disclosure will be described with reference to FIGS. 12A and 12B. An information apparatus of the fourth illustrative embodiment has a structure similar to the information apparatus of the third illustrative embodiment. Therefore, the same parts are designated with the same numerals and explanations for those parts will be omitted. There may be a difference between the third illustrative embodiment and the fourth illustrative embodiment in the structure of the opening/closing detection switches. Hereinafter, an opening/closing detection switch 217 of the fourth illustrative embodiment will be described. In the forth illustrative embodiment, a traveling contact 214 of the opening/closing detection switch 217 includes a metallic Belleville spring 250 having conductivity. With the provision of the Belleville spring 250, the switching of the on and off states can be improved in the opening/closing detection switch 217, so that a quick response can be made in accordance with the opening and closing of the first cover member 203. In addition, the opening/closing detection switch 217 can be quickly turned to the off state even after the opening/closing detection switch 217 stays on the on state for a while.

As described above, in the information apparatus according to the fourth illustrative embodiment, the traveling contact 214 includes the conductive Belleville spring 250 that covers the fixed contact 215 under the rubber spring 213 in the opening/closing detection switch 217. With this structure, the switching of the on and off of the opening/closing detection switch 217 can be improved. Further, the creep deformation can be prevented in the rubber spring 213 of the opening/closing detection switch 217.

A fifth illustrative embodiment will be described with reference to FIGS. 13A and 13B. An information apparatus of the fifth illustrative embodiment has a structure similar to the information apparatus 1 of the first illustrative embodiment. Therefore, the same parts are designated with the similar numerals and explanations for those parts will be omitted. There may be a difference between the first illustrative embodiment and the fifth illustrative embodiment in the structure of the opening/closing detection switches. Hereinafter, an opening/closing detection switch 317 of the fifth illustrative embodiment will be described.

First, structures of keyswitches 305 and the opening/closing detection switch 317 will be described. As shown in FIG. 13A, a keyswitch 305 includes a switching portion 316 that is implemented by which a rubber spring 313 made of, for example, silicone rubber, having a traveling contact 314, may be disposed at a position opposite to a corresponding fixed contact 315 of the circuit board 311 provided with a number of fixed contacts 315 thereon. The keyswitch 305 further includes a head portion 318 at the rubber spring 313. The rubber spring 313 generally protrudes upward through a guide hole 319 provided in an operating panel cover 307 such that its head portion 318 projects above a surface of the operating panel cover 307. In the same manner, other rubber springs 313, each of which has a traveling contact 314 and a head portion 318, are disposed at positions opposite to the other corresponding fixed contacts 315 provided on the circuit board 311. By this structure, the number of keyswitches 305 are provided. Some of the head portions 318 of the rubber springs 313 have characters, letters, or symbols indicated or displayed on their tops. As described above, the rubber springs 313 are continuous with each other to form the rubber spring sheet 310.

The opening/closing detection switch 317 may be formed in the empty space left in the circuit board 311 and the rubber spring sheet 310 at the same time when the circuit board 311 and the rubber spring sheet 310 are formed. As a result, no additional cost is incurred. The opening/closing detection switch 317 includes a switching portion 316 that is implemented by which a rubber spring 313 made of, for example, silicone rubber, having an annular traveling contact 314, may be disposed at a position opposite to a corresponding annular fixed contact 315 provided on the circuit board 311. The opening/closing detection switch 317 further includes a head portion 327 at its rubber spring. The head portion 327 of the opening/closing detection switch 317 may be shorter than the head portions 318 of the rubber springs 313 of the keyswitches 5. Therefore, the head portion 327 of the opening/closing detection switch 317 does not protrude above the surface the operating panel cover 307. In the rubber spring 313 of the opening/closing detection switch 317, the traveling contact 314 protrudes below the rubber spring sheet 310 in a part condition so as to have an urging force in itself in a mounted condition. With this structure, when the first cover member 303 may be opened with respect to the second cover member (not shown), as shown in FIG. 13A, the annular traveling contact 314 may be contacted with the annular fixed contact 315 of the circuit board 311 by the urging force of the traveling contact 314. Therefore, it can be detected that the first cover member 303 may be opened with respect to the second cover member. When the first cover member 303 is closed with respect to the second cover member, as shown in FIG. 13B, a tip portion 341 of a projecting portion 340 provided at a second cover 339 of the second cover member upwardly pushes a substantially center of the rubber spring 313, so that the fixed contact 315 of the circuit board 311 and the traveling contact 314 of the rubber spring 313 are separated from each other. Therefore, it can be detected that the first cover member 303 may be closed with respect to the second cover member.

Figure 13A:
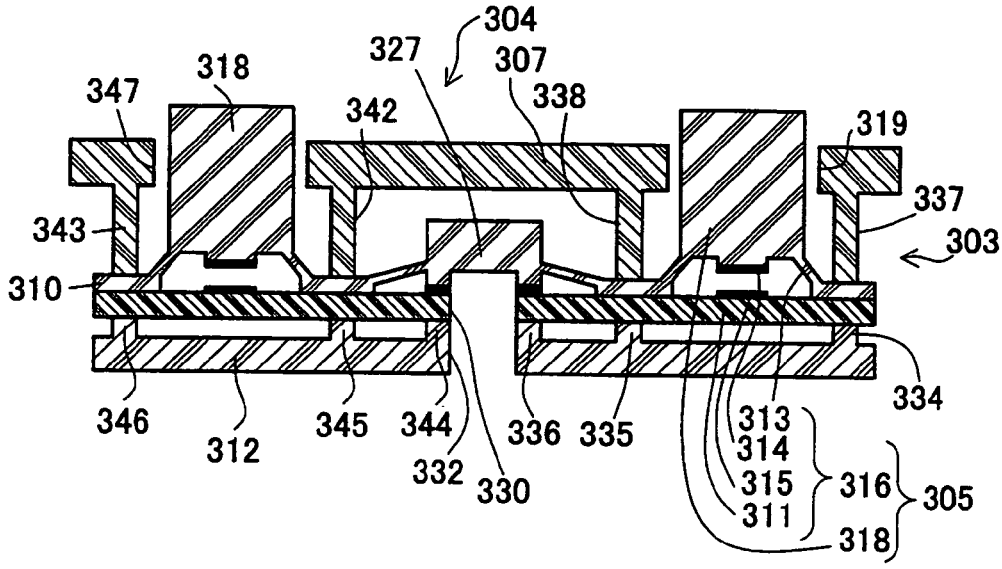
FIG. 13A is a sectional view of an operating panel provided with an opening/closing detection switch according to a fifth illustrative embodiment, wherein a first cover member is opened and the opening/closing detection switch is in an on state.
Figure 13B:
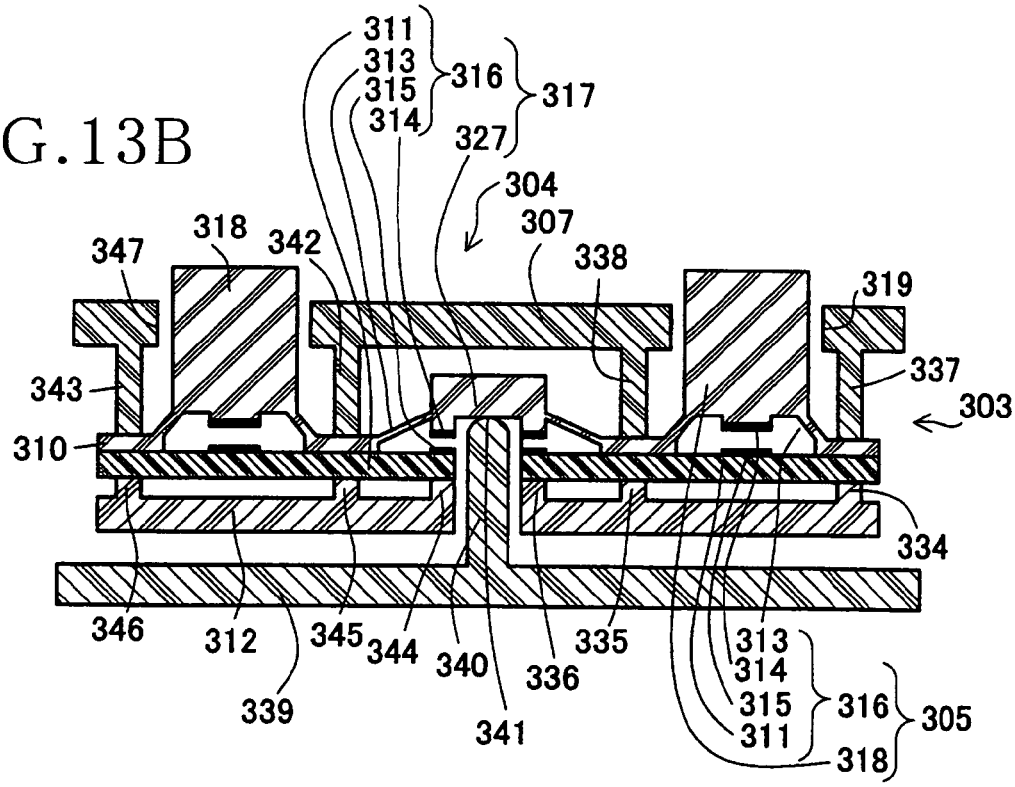
FIG. 13B is a sectional view of the operating panel provided with the opening/closing detection switch according to the fifth illustrative embodiment, wherein the first cover member is closed and the opening/closing detection switch is in an off state.

Referring to FIGS. 13A, and 13B, operation of the keyswitches 305 and the opening/closing detection switch 317 will be described. First, the operation of the keyswitches 305, except the keyswitch 305 for the opening/closing detection switch 317, will be described. All the keyswitches 305, except the keyswitch 305 for the opening/closing detection switch 317, function in the same manner, so that the description will be made on one of the keyswitches 305 only. The keyswitch 305 is in the off state unless its head portion 318 is not pressed down by the user because the fixed contact 315 of the circuit board 311 and the traveling contact 314 of the rubber spring 313 are separated from each other as shown in FIGS. 13A and 13B. When the head portion 318 of the keyswitch 305 is pressed down by the user, the fixed contact 315 and the traveling contact 314 are contacted with each other and the keyswitch 305 becomes the on state. At that time, data indicating a function assigned to the pressed keyswitch 305 is inputted. Next, the operation of the opening/closing detection switch 317 will be described. When the first cover member 303 is closed with respect to the second cover member, the state of the opening/closing detection switch 317 is as shown in FIG. 13B. That is, the tip portion 341 of the projecting portion 340 provided at the second cover 339 of the second cover member passes through a through hole 330 of the circuit board 331 and a through hole 332 of the first cover 312 to upwardly push the center of the rubber spring 313, so that the fixed contact 315 of the circuit board 311 and the traveling contact 314 of the rubber spring 313 are separated from each other. Therefore, the opening/closing detection switch 317 is in the off state. The controller determines the off state of the opening/closing detection switch 317 as that the first cover member 303 is closed with respect to the second cover member. When the first cover member 303 is opened with respect to the second cover member, the state of the opening/closing detection switch 317 is as shown in FIG. 13A. That is, the above-described structure of the rubber spring 313 allows the annular traveling contact 314 to be urged and contacted with the annular fixed contact 315 of the circuit board 311. Therefore, the opening/closing detection switch 317 is in the on state. The controller determines the on state of the opening/closing detection switch 317 as that the first cover member 303 is opened with respect to the second cover member, so that the controller takes safety measures to inform the user of the opening of the first cover member 303.

As described above, in the information apparatus according to the fifth illustrative embodiment, the annular fixed contact 315 and the annular traveling contact 314 are provided centering around the rubber spring 313 in the opening/ closing detection switch 317 and are in contact with each other at all times. The circuit board 311 and the first cover 312 are provided with the through holes 330 and 332, respectively, at the positions corresponding to the center of the rubber spring 313 of the opening/closing detection switch 317. When the first cover member 303 is closed with respect to the second cover member, the tip portion 341 of the projecting portion 340 of the second cover 339 disposed at the bottom of the first cover member 303 passes through the through holes 330, 332 and upwardly pushes the substantially center of the rubber spring 313 of the opening/closing detection switch 317, so that the fixed contact 315 and the traveling contact 314 are separated from each other. With this structure, it is unnecessary to provide an elastic member for always applying a pressing force to the rubber spring 313 of the opening/closing detection switch 317. In addition, a movable member does not exist between the fixed contact 315 and the traveling contact 314, so that a manufacturing cost can be reduced. Further, the reduction of the parts count can improve reliability of the information apparatus.

Figure 14A:
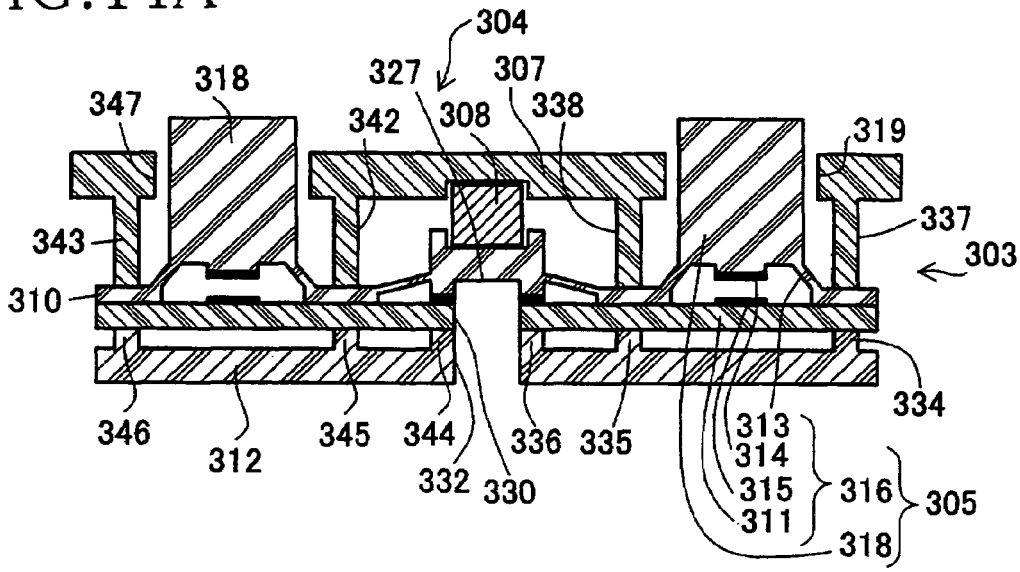
FIG. 14A is a sectional view of an operating panel provided with an opening/closing detection switch according to a sixth illustrative embodiment, wherein a first cover member is opened and the opening/closing detection switch is in an on state.
Figure 14B:
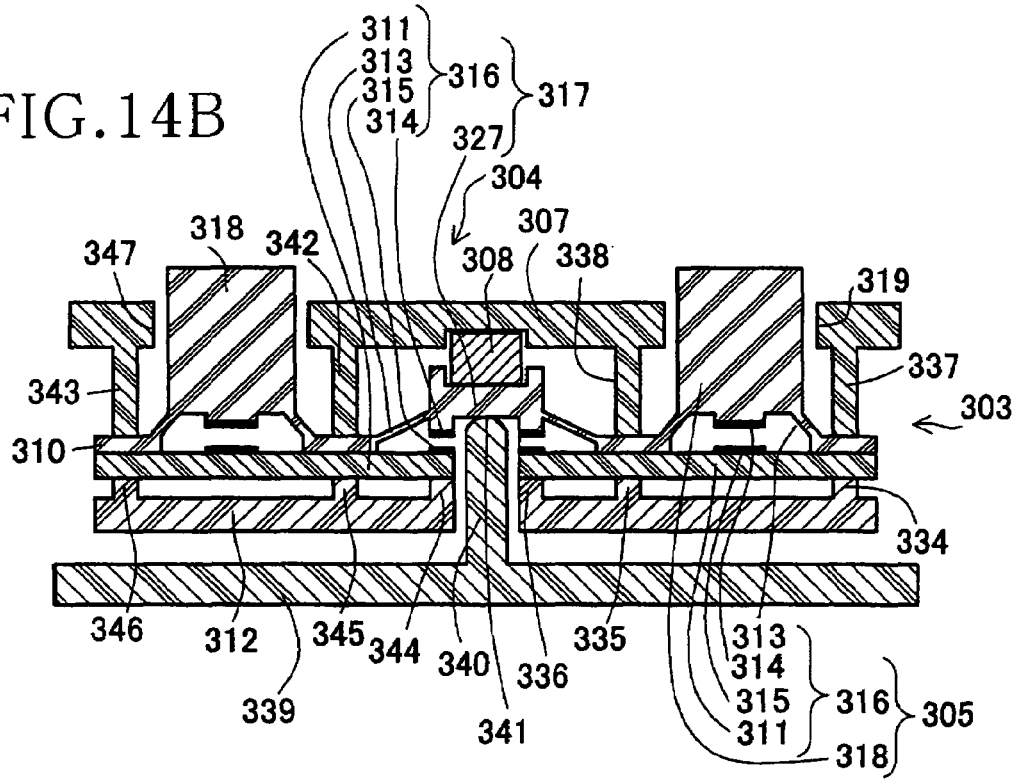
FIG. 14B is a sectional view of the operating panel provided with the opening/closing detection switch according to the sixth illustrative embodiment, wherein the first cover member is closed and the opening/closing detection switch is in an off state.

A sixth illustrative embodiment of the disclosure will be described with reference to FIGS. 14A and 14B. The sixth illustrative embodiment is similar to the fifth illustrative embodiment. Therefore, the same parts are designated with the same numerals and explanations for those parts will be omitted. There is a difference between the fifth illustrative embodiment and the sixth illustrative embodiment in the structure of the opening/closing detection switches. Hereinafter, an opening/closing detection switch 317 of the sixth illustrative embodiment will be described. Between a head portion 327 of a rubber spring 313 of the opening/closing detection switch 317 and an operating panel cover 307, a spring 308 (functioning as the elastic member) is provided. With the provision of the spring 308, a pressing force is always applied to the head portion 327 of the rubber spring 313 in the opening/closing detection switch 317, so that an annular traveling contact 314 is stably contacted with an annular fixed contact 315.

As described above, in the information apparatus according to the sixth illustrative embodiment, the spring 308, which always applies the pressing force to the head portion 327 of the rubber spring 313, may be provided in the opening/closing detection switch 317. Therefore, when the first cover member 303 is opened with respect to the second cover member, the opening/closing detection switch 317 can be further surely maintained in the on state, thereby improving the reliability of the information apparatus. In addition, the creep deformation can be prevented in the rubber spring 313 of the opening/closing detection switch 317.

Figure 15A:
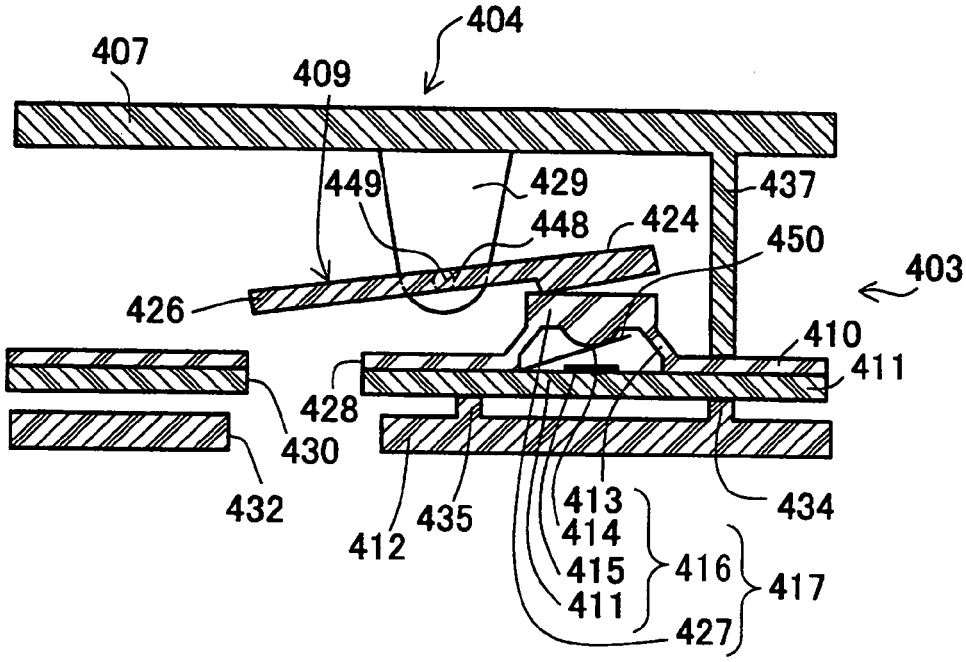
FIG. 15A is a sectional view of an operating panel provided with an opening/closing detection switch according to a seventh illustrative embodiment, wherein a first cover member is opened and the opening/closing detection switch is in an off state.
Figure 15B:
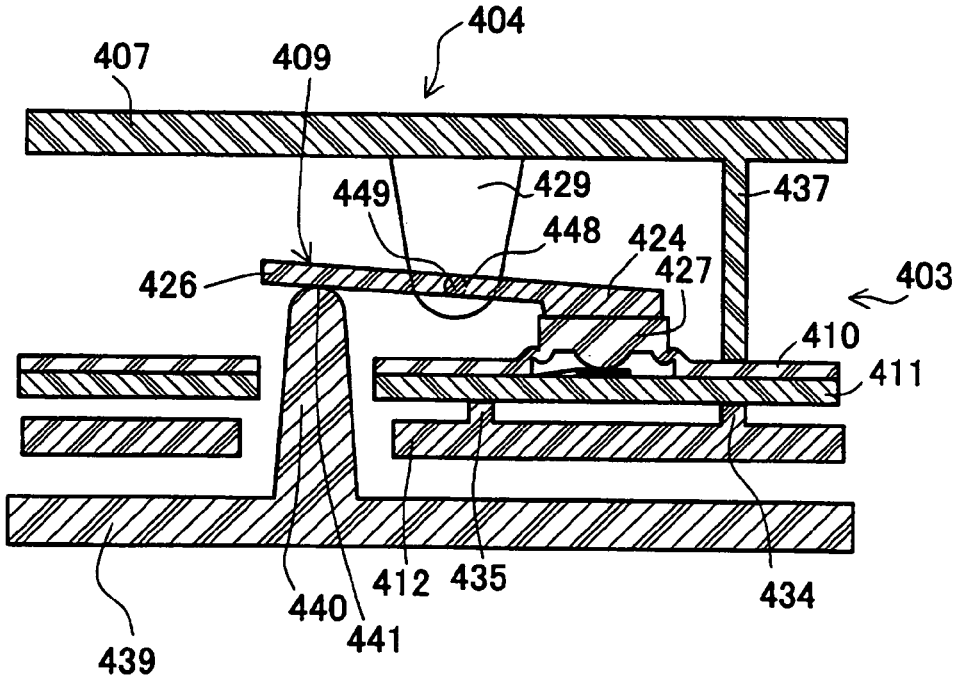
FIG. 15B is a sectional view of the operating panel provided with the opening/closing detection switch according to the seventh illustrative embodiment, wherein the first cover member is opened and the opening/closing detection switch is in an on state.

A seventh illustrative embodiment of the disclosure will be described with reference to FIGS. 15A and 15B. An information apparatus of the seventh illustrative embodiment is also similar to the information apparatus of the above-described illustrative embodiments. Therefore, the same parts are designated with the similar numerals and explanations for those parts will be omitted. In the information apparatus according to this illustrative embodiment, an opening/closing detection switch 417 is implemented by further another method.

First, a structure of the opening/closing detection switch 417 will be described below. The opening/closing detection switch 417 includes a switching portion 416 and a head portion 427. The switching portion 416 includes one of a number of fixed contacts 415 provided on a circuit board 411, and a conductive metal spring 450 (functioning as a deformation release member) having a traveling contact 414 provided in one of a number of rubber springs 413 of a rubber spring sheet 410. An actuator 409 is rotatably supported by a rotation support portion 429 provided at an operating panel cover 407 by which a rotation support pin 449 of the actuator 409 is fitted to a support hole 448 of the rotation support portion 429. The actuator 409 includes a rubber spring pressing portion 424 (functioning as a pressing portion) at its one end and an acting end 426 (functioning as another end) at its another end. The rotation support pin 449 may be provided at a substantially middle of the actuator 409 between the ends. When a first cover member, 403 is opened with respect to the second cover member, as shown in FIG. 15A, there is no force acting on the acting end 426 of the actuator 409 to upwardly push it. Thus, the rubber spring 413 returns to its original state and the fixed contact 415 and the traveling contact 414 are separated from each other in the opening/closing detection switch 417. When the first cover member 403 is closed with respect to the second cover member, as shown in FIG. 15B, a tip portion 441 of a projecting portion 430 provided at a second cover 439 of the second cover member upwardly pushes the acting end 426 of the actuator 409, so that the rubber spring pressing portion 424 of the actuator 409 presses down the rubber spring 413 to allow the traveling contact 414 to contact the fixed contact 415.

Next, operation of the opening/closing detection switch 417 will be described. When the first cover member 403 is closed, the state of the opening/closing detection switch 417 is as shown in FIG. 15B. That is, the tip portion 441 of the projecting portion 440 provided at the second cover 439 passes through a through hole 432 of the first cover 412, a through hole 430 of the circuit board 411, and a through hole 428 of the rubber spring sheet 410 and upwardly pushes the acting end 426 of the actuator 409, so that the rubber spring pressing portion 424 of the actuator 409 downwardly presses the rubber spring 413 to allow the traveling contact 414 to contact the fixed contact 415. Thus, the opening/closing detection switch 417 may be in the on state. The controller determines the on state of the opening/closing detection switch 417 as that the first cover member 403 is closed with respect to the second cover member. When the first cover member 403 is opened, the state of the opening/closing detection switch 417 may be as shown in FIG. 15A. That is, there is no force acting on the acting end 426 of the actuator 409 to upwardly push it, so that the rubber spring 413 returns to its original state and the fixed contact 415 and the traveling contact 414 are separated from each other. Thus, the opening/closing detection switch 417 is in the off state. The controller determines the on state of the opening/closing detection switch 417 as that the first cover member 403 is opened with respect to the second cover member, so that the controller takes safety measures to inform the user of the opening of the first cover member 403. A period of time during which the rubber spring 413 is pressed downward is long. However, by the provision of the conductive metal spring 450, the rubber spring 413 directly returns to its original state when the pressing of the rubber spring 413 by the rubber spring pressing portion 424 of the actuator 409 is released, so that there is no functional problem in the rubber spring 413 of the opening/closing detection switch 417. In addition, the rubber spring 413 also serves as a dust shield in the opening/closing detection switch 417.

As described above, in the information apparatus according to the seventh illustrative embodiment, the opening/closing detection switch 417 includes the traveling contact 414 of the conductive metal spring 450 that covers the fixed contact 415 disposed under the rubber spring 413, and the actuator 409 that is capable of pressing the rubber spring 413. The actuator 409 may be rotatably supported at its substantially middle portion by the rotation support portion 429 provided at the first cover member 403. When the first cover member 403 is closed, the end portion 441 of the projecting portion 440 of the second cover 439 disposed under the first cover member 403 upwardly pushes the acting end 426 of the actuator 409 and the rubber spring pressing end 424 of the actuator 409 presses down the head portion 427 of the rubber spring 413. By doing so, the fixed contact 415 and the traveling contact 414 are contacted with each other. This structure may be effective when the opening/closing detection switch 417 needs to be maintained at the on state when the first cover member 403 is closed. Although a period of time during which the rubber spring 413 is pressed is long, the conductive metal spring 450 makes the switching of on and off states of the opening/closing detection switch 417 better. In addition, the creep deformation can be prevented in the rubber spring 413 of the opening/closing detection switch 417.

Figure 16A:
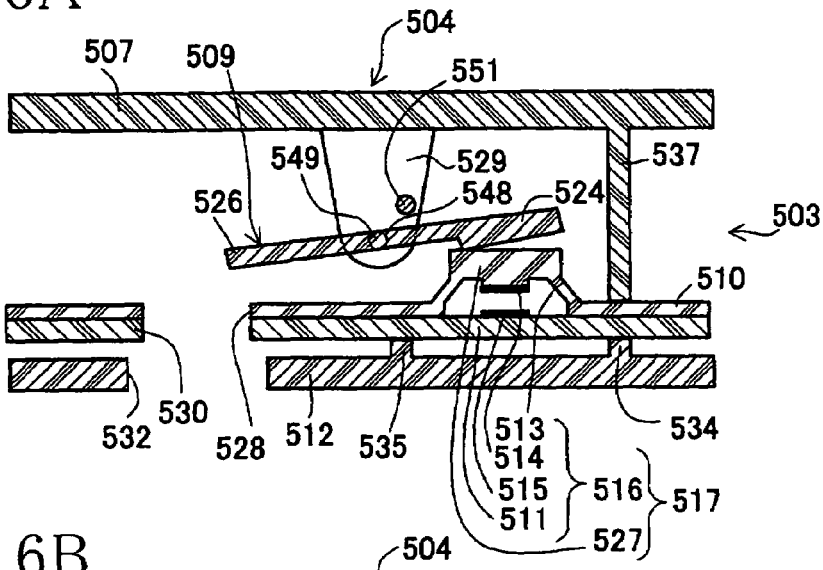
FIG. 16A is a sectional view of an operating panel provided with an opening/closing detection switch according to an eighth illustrative embodiment, wherein a first cover member is opened and the opening/closing detection switch is in an off state.
Figure 16B:
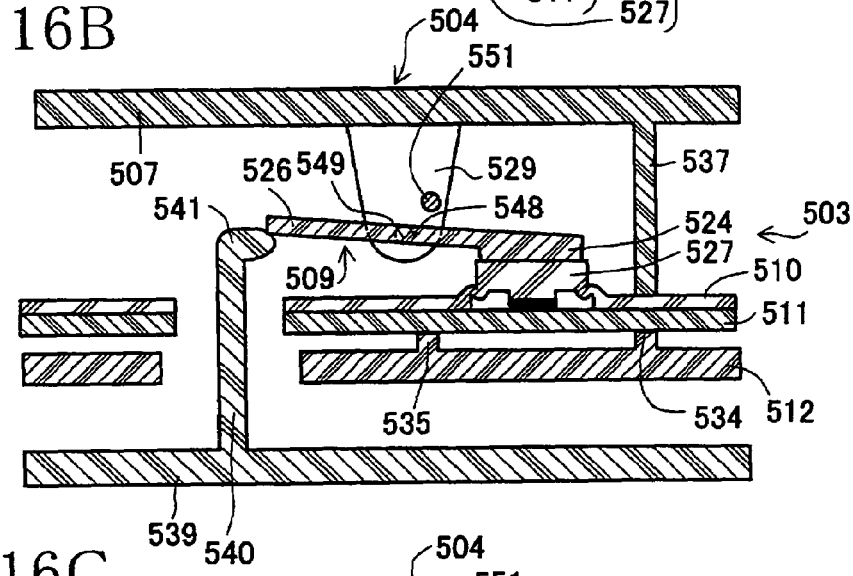
FIG. 16B is a sectional view of the operating panel provided with the opening/closing detection switch according to the eighth illustrative embodiment, wherein the first cover member is half closed and the opening/closing detection switch is in an on state.
Figure 16C:
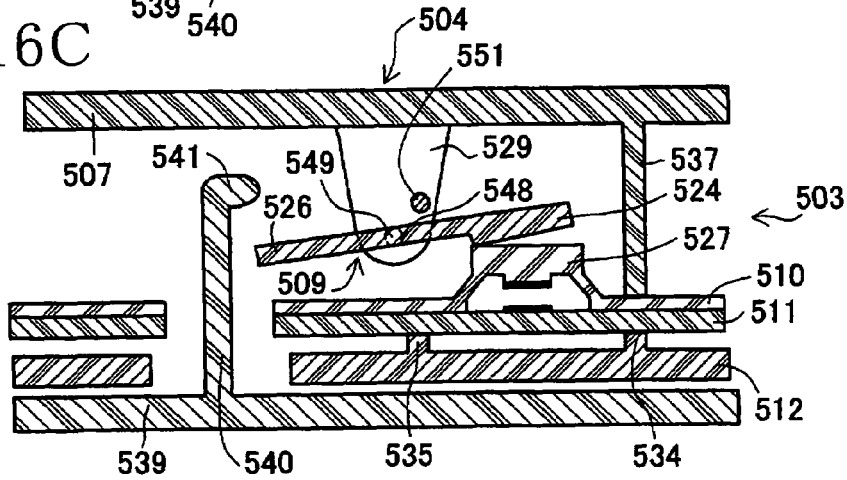
FIG. 16C is a sectional view of the operating panel provided with the opening/closing detection switch according to the eighth illustrative embodiment, wherein the first cover member is completely closed and the opening/closing detection switch is in the off state.

An eighth illustrative embodiment of the disclosure will be described with reference to FIGS. 16A, 16B, and 16C. An information apparatus of the eighth illustrative embodiment is also similar to the information apparatus of the above-described illustrative embodiments. Therefore, the same parts are designated with the similar numerals and explanations for those parts will be omitted. In the information apparatus according to this illustrative embodiment, an opening/closing detection switch 517 is implemented by further another method.

First, a structure of the opening/closing detection switch 517 will be described. The opening/closing detection switch 517 includes a switching portion 516 and a head portion 527. The switching portion 516 includes one of a number of fixed contacts 515 provided on a circuit board 511, one of a number of rubber springs 513 which are provided on a rubber spring sheet 510 and each of which has a traveling contact 514. An actuator 509 may be rotatably supported by a rotation support portion 529 provided at an operating panel cover 507 by which a rotation support pin 549 of the actuator 509 is fitted to a support hole 548 of the rotation support portion 529. The actuator 509 includes a rubber spring pressing portion 524 (functioning as a pressing portion) at its one end and an acting end 526 (functioning as another end) at its another end. The rotation support pin 549 may be provided at a substantially middle of the actuator 509 between the ends. When a first cover member 503 is opened with respect to the second cover member, as shown in FIG. 16A, there is no force acting on the acting end 526 of the actuator 509 to upwardly push it. Thus, the rubber spring 513 returns to its original state and the fixed contact 515 and the traveling contact 514 are separated from each other. Before the first cover member 503 is completely closed with respect to the second cover member, that is, in process of closing the first cover member 503 with respect to the second cover member, as shown in FIG. 16B, an end portion 541, having an oval shape in section, of a substantially L-shaped projecting portion 540 provided at a second cover 539 of the second cover member upwardly pushes the acting end 526 of the actuator 509, so that the end portion 541 of the projecting portion 540 of the second cover 539 of the second cover member upwardly pushes the acting end 526 of the actuator 509. Thus, the rubber spring pressing portion 524 of the actuator 509 presses down the rubber spring 513 to allow the traveling contact 514 to contact the fixed contact 515 for a certain time. When the first cover member 503 is completely closed with respect to the second cover member, as shown in FIG. 16C, the acting end 526 of the actuator 509 is separated from the end portion 541 of the projecting portion 540 of the second cover 539 by the elasticity of the projecting portion 540 or the acting end 526, so that the rubber spring 513 returns to its original state and the fixed contact 515 and the traveling contact 514 are separated from each other.

Next, operation of the opening/closing detection switch 517 will be described. When the first cover member 503 is opened with respect to the second cover member, as shown in FIG. 16A, there may be no force acting on the acting end 526 of the actuator 509 to upwardly push it, so that the rubber spring 513 returns to its original state and the fixed contact 515 and the traveling contact 514 are separated from each other. Before the first cover member 503 is completely closed with respect to the second cover member, as shown in FIG. 16B, the projecting portion 540 provided at the second cover 539 upwardly pushes the acting end 526 of the actuator 509 by its end portion 541. Thus, the rubber spring pressing portion 524 of the actuator 509 downwardly presses the rubber spring 513 to allow the traveling contact 514 to contact the fixed contact 515 for a certain time. While the traveling contact 514 and the fixed contact 515 are in contact with each other, the opening/closing detection switch 517 is in the on state. In accordance with the switching of the state of the opening/closing detection switch 517 from the off state to the on state, the controller determines that the first cover member 503 is closed with respect to the second cover member. When the first cover member 503 is completely closed with respect to the second cover member, as shown in FIG. 16C, the acting end 526 of the actuator 509 may be separated from the end portion 541 of the projecting portion 540 of the second cover 539 by the elasticity of the projecting portion 540 or the acting end 526, so that the rubber spring 513 returns to its original state and the fixed contact 515 and the traveling contact 514 are separated from each other. With this structure, the rubber spring 513 is avoided being kept in the pressed state. When the opening/closing detection switch 517 is returned to the state of FIG. 16A, the acting end 526 of the actuator 509 may be once caught by the end portion 541 of the projecting portion 540 of the second cover 539 and may be separated from the end portion 541 of the projecting portion 540 by the elasticity of the projecting portion 540 or the acting end 526 of the actuator 509. Thus, the opening/closing detection switch 517 returns to the state shown in FIG. 16A. In order to smoothly perform the above operation, a stopper pin 551 (functioning as a restricting member) is provided so that the actuator 509 does not further rotate unnecessarily.

As described above, in the information apparatus according to the eighth illustrative embodiment, the opening/closing detection switch 517 includes the actuator 509 capable of downwardly pressing the rubber spring 513. The actuator 509 may be rotatably supported at its substantially middle portion by the rotation support portion 529 provided at the first cover member 503. In the process of closing the first cover member 503, the acting end 526 of the actuator 509 may be upwardly pushed by the end portion 541 of the projecting portion 540 of the second cover 539 disposed under the first cover member 503 and the rubber spring 513 may be pressed down by the rubber spring pressing portion 524 of the actuator 509, so that the fixed contact 515 and the traveling contact 514 of the opening/closing detection switch 517 are contacted with each other. Immediately before the first cover member 503 is completely closed with respect to the second cover member, the acting end 526 of the actuator 509 may be separated from the end portion 541 of the projecting portion 540 by the elasticity of the projecting portion 540 or the acting end 526 of the actuator 509, so that the opening/closing detection switch 517 returns to its original state and the fixed contact 515 and the traveling contact 514 are separated from each other. With this structure, the rubber spring 513 can return to its original state by its return force when the first cover member 503 is closed, so that the creep deformation hardly develops in the rubber spring 513 in the opening/closing detection switch 517.

An ninth illustrative embodiment of the disclosure will be described with reference to FIGS. 17A to 18C. An information apparatus of the ninth illustrative embodiment is also similar to the information apparatus of the above-described illustrative embodiments. Therefore, the same parts are designated with the similar numerals and explanations for those parts will be omitted. In the information apparatus according to this illustrative embodiment, an opening/closing detection switch 617 is implemented by further another method.

Figure 17A:
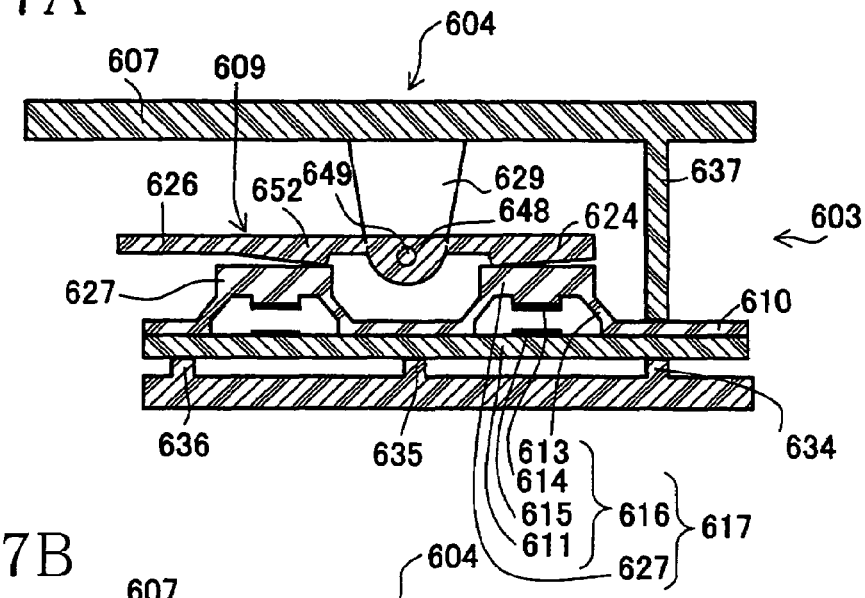
FIG. 17A is a sectional view of an operating panel provided with right and left opening/closing detection switches according to a ninth illustrative embodiment, showing operations of the right and left opening/closing detection switches during closing of the operating panel, wherein a first cover member is opened and both the right and left opening/closing detection switches are in an off state.
Figure 17B:
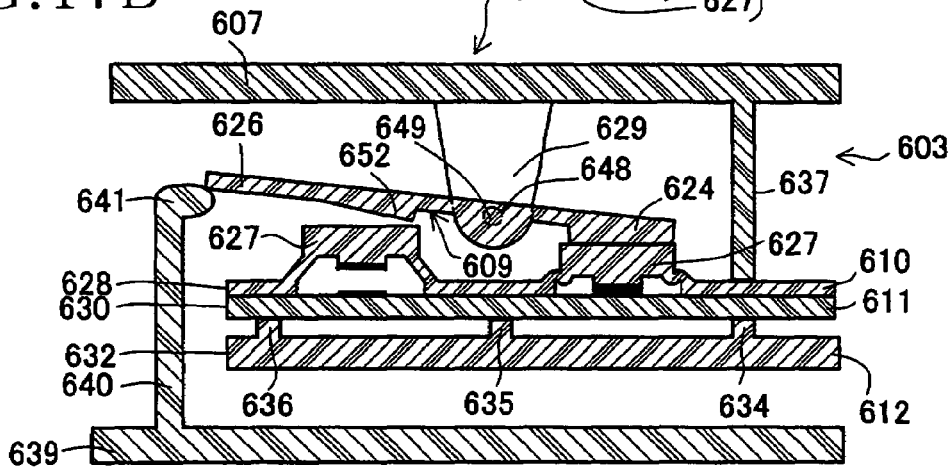
FIG. 17B is a sectional view of the operating panel provided with the right and left opening/closing detection switches according to the ninth illustrative embodiment, showing the operations of the right and left opening/closing detection switches during closing of the operating panel, wherein the first cover member is half closed and the left opening/closing detection switch is in an off state and the right opening/closing detection switch is in an on state.
Figure 17C:
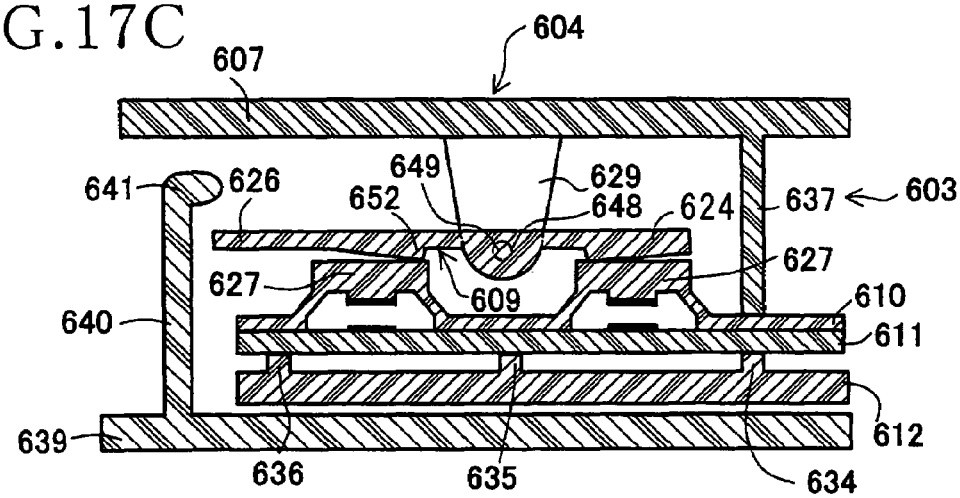
FIG. 17C is a sectional view of the operating panel provided with the right and left opening/closing detection switches according to the ninth illustrative embodiment, showing the operations of the right and left opening/closing detection switches during closing of the operating panel, wherein the first cover member is completely closed and both the right and left opening/closing detection switches are in the off state.
Figure 18A:
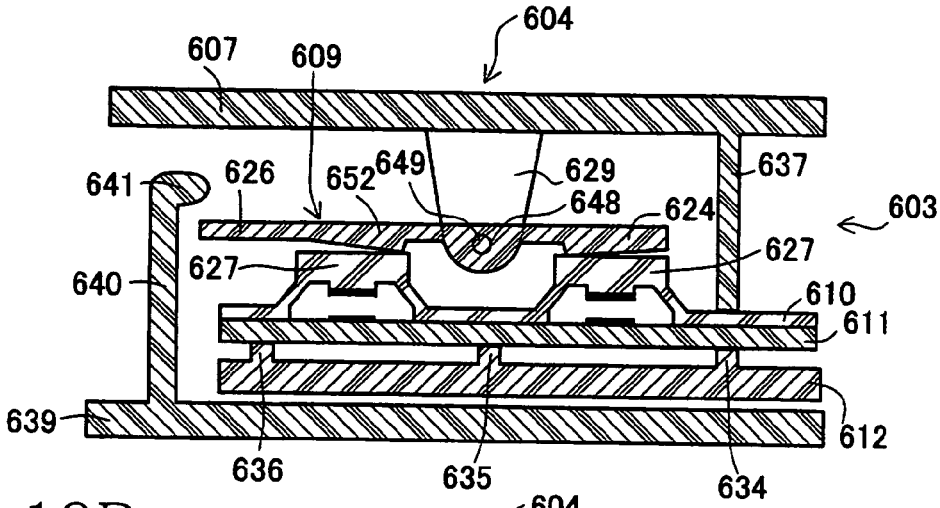
FIG. 18A is a sectional view of an operating panel provided with right and left opening/closing detection switches according to the ninth illustrative embodiment, showing operations of the right and left opening/closing detection switches during opening of the operating panel, wherein the first cover member is completely closed and both the right and left opening/closing detection switches are in the off state.
Figure 18B:
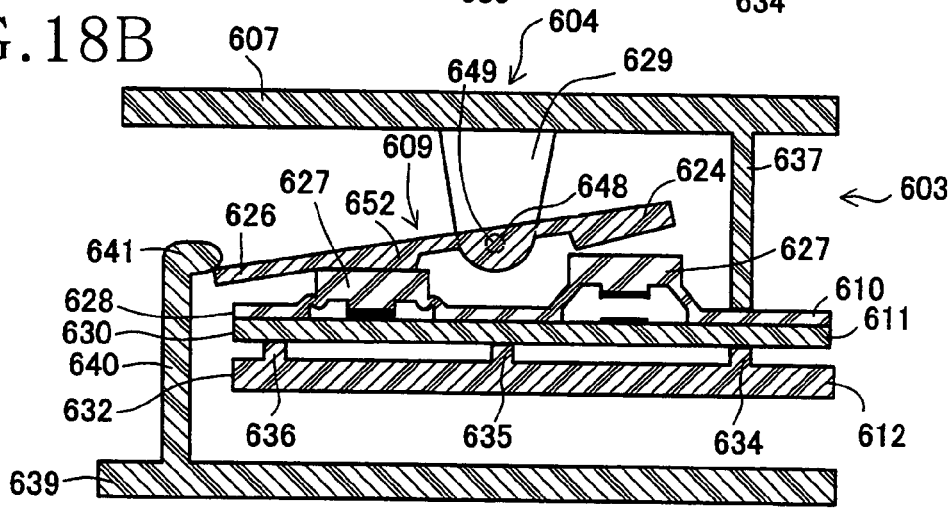
FIG. 18B is a sectional view of the operating panel provided with the right and left opening/closing detection switches according to the ninth illustrative embodiment, showing the operations of the right and left opening/closing detection switches during opening of the operating panel, wherein the first cover member is being opened and the left opening/closing detection switch is in the on state and the right opening/closing detection switch is in the off state.
Figure 18C:
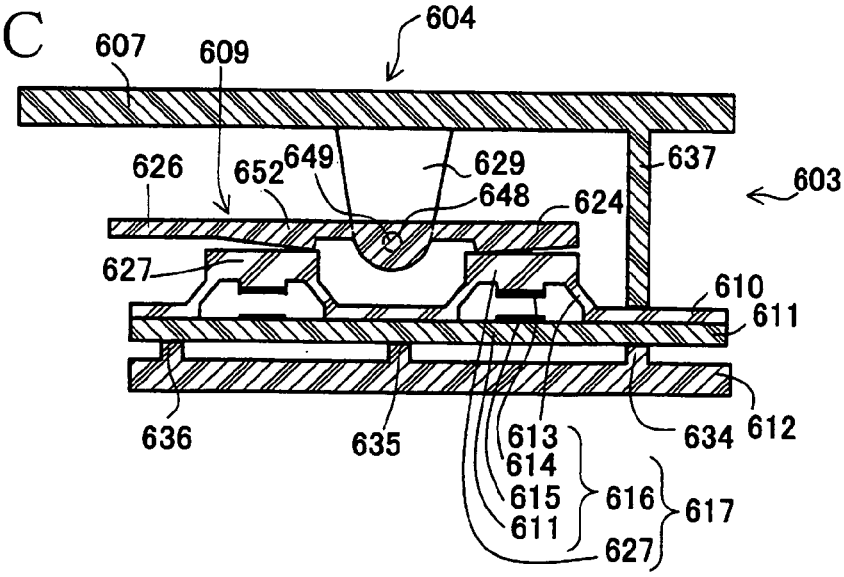
FIG. 18C is a sectional view of the operating panel provided with the right and left opening/closing detection switches according to the ninth illustrative embodiment, showing the operations of the right and left opening/closing detection switches during opening of the operating panel, wherein the first cover member is completely opened and both the left and right opening/closing detection switches are in the off state.

First, a structure of the opening/closing detection switch 617 will be described below. The opening/closing detection switch 617 includes a switching portion 616 and a head portion 627. The switching portion 616 includes one of a number of fixed contacts 615 provided at a circuit board 611, one of a number of rubber springs 613 which are provided on a rubber spring sheet 610 and each of which has a traveling contact 614. In this illustrative embodiment, two opening/closing detection switches 617 are provided. An actuator 609 includes a right rubber spring pressing portion 624 (functioning as a first pressing portion) at one end, an acting end 626 at another end, and a left rubber spring pressing portion 652 between the right rubber spring pressing portion 624 and the acting end 626. The actuator 609 may be rotatably supported by a rotation support portion 629 provided at an operating panel cover 607 via a rotation support pin 649 provided between the right and left rubber pressing portions 624, 652. When the first cover member 603 is opened with respect to the second cover member, as shown in FIG. 17A, there are no force acting on the acting end 626 of the actuator 609 to upwardly push it, so that the rubber springs 613 of the opening/closing detection switches 617 are maintained in their original state and the traveling contacts 614 are separated from the respective fixed contacts 615. Before the first cover member 603 is completely closed with respect to the second cover member, that is, in process of closing the first cover member 603 with respect to the second cover member, as shown in FIG. 17B, an end portion 641, having an oval shape in section, of a substantially L-shaped projecting portion 640 provided to a second cover 639 of the second cover member upwardly pushes the acting end 626 of the actuator 609, so that the end portion 641 of the projecting portion 640 provided to the second cover 639 of the second cover member upwardly pushes the acting end 626 of the actuator 609. Thus, the right rubber spring pressing portion 624 of the actuator 609 presses down the right rubber spring 613 to allow the traveling contact 614 to contact the fixed contact 615 in the right rubber spring 613. When the first cover member 603 is completely closed with respect to the second cover member, as shown in FIG. 17C, the acting end 626 of the actuator 609 may be separated from the end portion 641 of the projecting portion 640 of the second cover 639 by the elasticity of the projecting portion 640 or the acting end 626, so that the right rubber spring 613 returns to its original state and the fixed contact 615 and the traveling contact 614 are separated from each other in the right rubber spring 613. While the first cover member 603 is completely closed with respect to the second cover member, as shown in FIG. 18A, there are no force acting on the acting end 626 of the actuator 609 to upwardly push it, so that the right and left rubber springs 613 are in their original state and the fixed contacts 615 and the traveling contacts 614 are separated from each other in the right and left rubber springs 613. Immediately after the first cover member 603 is started being opening with respect to the second cover member, that is, in process of opening the first cover member 603, as shown in FIG. 18B, the acting end 626 of the actuator 609 may be caught by the end portion 641 of the projecting portion 640 of the second cover 639, so that the left rubber spring pressing portion 652 downwardly presses the left rubber spring 613 and the fixed contact 615 and the traveling contact 614 are contacted with each other in the left rubber spring 613. When the first cover member 603 is completely opened, as shown in FIG. 18C, the acting end 626 of the actuator 609 may be separated from the end portion 641 of the projecting portion 640 by the elasticity of the projecting portion 640 or the acting end 626. Thus, the left rubber spring 613 returns to its original state and the fixed contact 615 and the traveling contact 614 are separated from each other in the left rubber spring 613.

Next, operation of the opening/closing detection switch 617 will be described. When the first cover member 603 is opened with respect to the second cover member, as shown in FIG. 17A, there are no force acting on the acting end 626 of the actuator 609 to upwardly push it, so that the rubber springs 613 of the opening/closing detection switches 617 are maintained in their original state and the traveling contacts 614 are separated from the respective fixed contacts 615. Before the first cover member 603 is completely closed with respect to the second cover member, that is, in process of closing the first cover member 603 with respect to the second cover member, as shown in FIG. 17B, the end portion 641 of the projecting portion 640 provided to the second cover 639 of the second cover upwardly pushes the acting end 626 of the actuator 609, so that the end portion 641 of the projecting portion 640 provided to the second cover 639 of the second cover member upwardly pushes the acting end 626 of the actuator 609. Thus, the right rubber spring pressing portion 624 of the actuator 609 presses down the right rubber spring 613 to allow the traveling contact 614 to contact the fixed contact 615 in the right rubber spring 613. While the traveling contact 614 and the fixed contact 615 are contacted with each other, the right opening/closing detection switch 617 may be in the on state. In accordance with the switching of the state of the opening/closing detection switch 617 from the off state to the on state, the controller determines that the first cover member 603 is closed with respect to the second cover member. When the first cover member 603 is completely closed with respect to the second cover member, as shown in FIG. 17C, the acting end 626 of the actuator 609 may be separated from the end portion 641 of the projecting portion 640 of the second cover 639 by the elasticity of the projecting portion 640 or the acting end 626, so that the right rubber spring 613 returns to its original state and the fixed contact 615 and the traveling contact 614 are separated from each other in the right rubber spring 613. With this structure, the right rubber spring 613 can be avoided being kept in the pressed state. While the first cover member 603 is completely closed with respect to the second cover member, as shown in FIG. 18A, there are no force acting on the acting end 626 of the actuator 609 to upwardly push it, so that the right and left rubber springs 613 are in their original state and the fixed contacts 615 and the traveling contacts 614 are separated from each other in the right and left rubber springs 613. Immediately after the first cover member 603 is started being opening with respect to the second cover member, that is, in process of opening the first cover member 603, as shown in FIG. 18B, the acting end 626 of the actuator 609 is caught by the end portion 641 of the projecting portion 640 of the second cover 639, so that the left rubber spring pressing portion 652 downwardly presses the left rubber spring 613 and the fixed contact 615 and the traveling contact 614 are contacted with each other in the left rubber spring 613. While the fixed contact 615 and the traveling contact 614 are contacted with each other, the left opening/closing detection switch 617 is in the on state. In accordance with the switching of the state of the left opening/closing detection switch 617, the controller determines that the first cover member 603 is opened with respect to the second cover member. When the first cover member 603 is completely opened, as shown in FIG. 18C, the acting end 626 of the actuator 609 is separated from the end portion 641 of the projecting portion 640 by the elasticity of the projecting portion 640 or the acting end 626. Thus, the left rubber spring 613 returns to its original state and the fixed contact 615 and the traveling contact 614 are separated from each other in the left rubber spring 613. With this structure, the left rubber spring 613 can be avoided being kept in the pressed state. As described above, by using the right and left opening/closing detection switches 617, trigger signals indicating the opening and closing of the first cover member 603 can be captured.

As described above, in the information apparatus according to the ninth illustrative embodiment, the two opening/closing detection switches 617 and the actuator 609 that presses the right and left rubber springs 613 alternately are provided. The actuator 609 is rotatably supported by the rotation support portion 629 provided at the first cover 603. In the process of closing the first cover member 603, the end portion 641 of the projecting portion 640 provided at the second cover 639 of the second cover member upwardly pushes the acting end 626 of the actuator 609 and the right rubber spring pressing portion 624 downwardly presses the head portion 627 of the right rubber spring 613. Thus, the fixed contact 615 and the traveling contact 614 are in contact with each other in the right rubber spring 613. Immediately before the first cover member 603 is completely closed with respect to the second cover member, the acting end 626 of the actuator 609 is separated from the end portion 641 of the projecting portion 640 by the elastic force of the actuator 609 or the projecting portion 640. With this structure, the right rubber spring 613 returns to its original state and the contact between the fixed contact 615 and the traveling contact 614 are released. In the process of opening the firs cover member 603, the acting end 626 of the actuator 609 is contacted with the end portion 641 of the projecting portion 640. Thus, the left rubber spring pressing portion 652 of the actuator 609 downwardly presses the left rubber spring 613, so that the fixed contact 615 and the traveling contact 614 are contacted with each other in the left rubber spring 613. Further, immediately before the first cover member 603 is completely opened, the acting end 626 of the actuator 609 is separated from the end portion 641 of the projecting portion 640 by the elastic force of the actuator 609 or the projecting portion 640. With this structure, the left rubber spring 613 returns to its original state and the contact between the fixed contact 615 and the traveling contact 614 are released. As described above, both when the first cover member 603 is completely closed and opened with respect to the second cover member, the right and left rubber springs 613 return to their original state on their own. With this structure, the creep deformation can be prevented in the rubber springs 613 of the right and left opening/closing detection switches 617. In addition, trigger signals indicating the opening and closing of the first cover member 603 can be outputted when the first cover member 603 is opened and closed with respect to the second cover member.

An tenth illustrative embodiment of the disclosure will be described with reference to FIGS. 19A to 21. An information apparatus of the tenth illustrative embodiment is also similar to the information apparatus of the above-described illustrative embodiments. Therefore, the same parts are designated with the similar numerals and explanations for those parts will be omitted. In the information apparatus according to this illustrative embodiment, an opening/closing detection switch 717 is implemented by further another method.

Figure 19A:
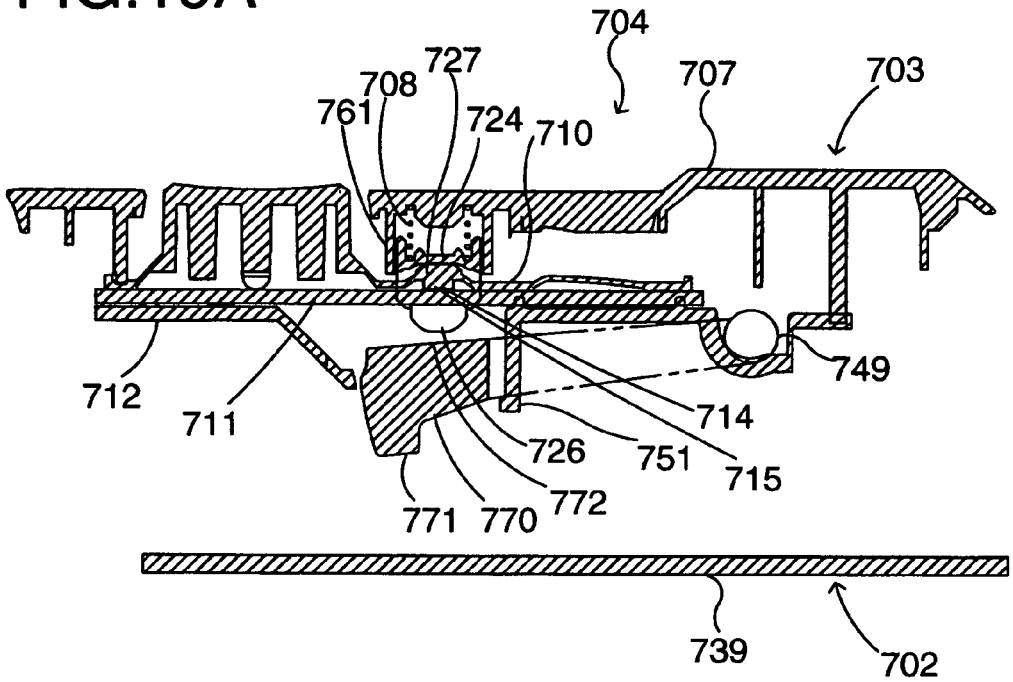
FIG. 19A is a sectional view of the operating panel according to the tenth illustrative embodiment, wherein the first cover member is opened and the opening/closing detection switch is in an on state in accordance with aspects of the present invention.
Figure 19B:
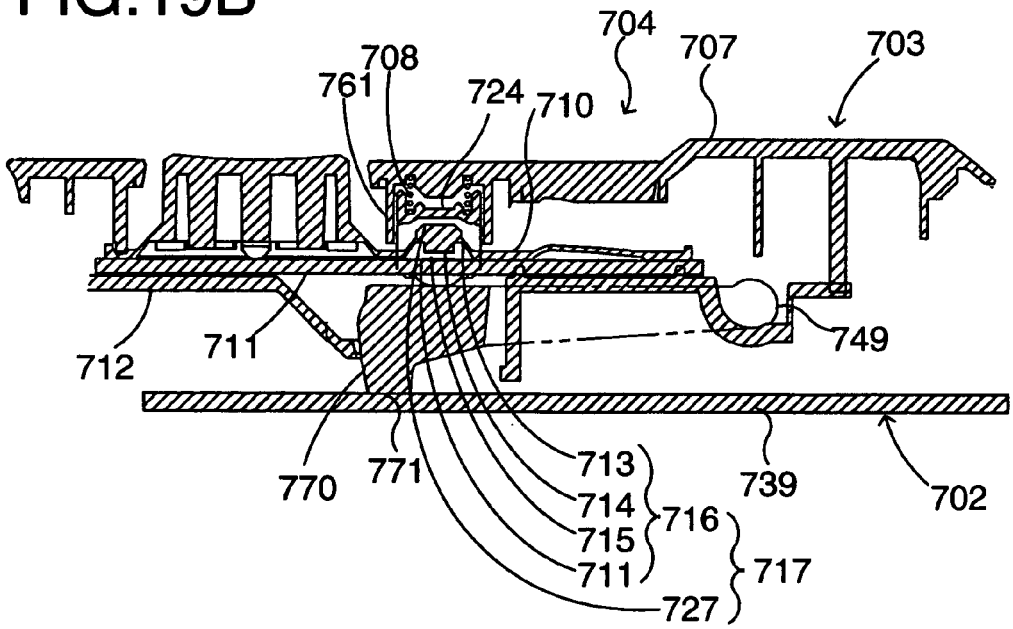
FIG. 19B is the sectional view of the operating panel according to the tenth illustrative embodiment, wherein the first cover member is closed and the opening/closing detection switch is in an off state.
Figure 20:
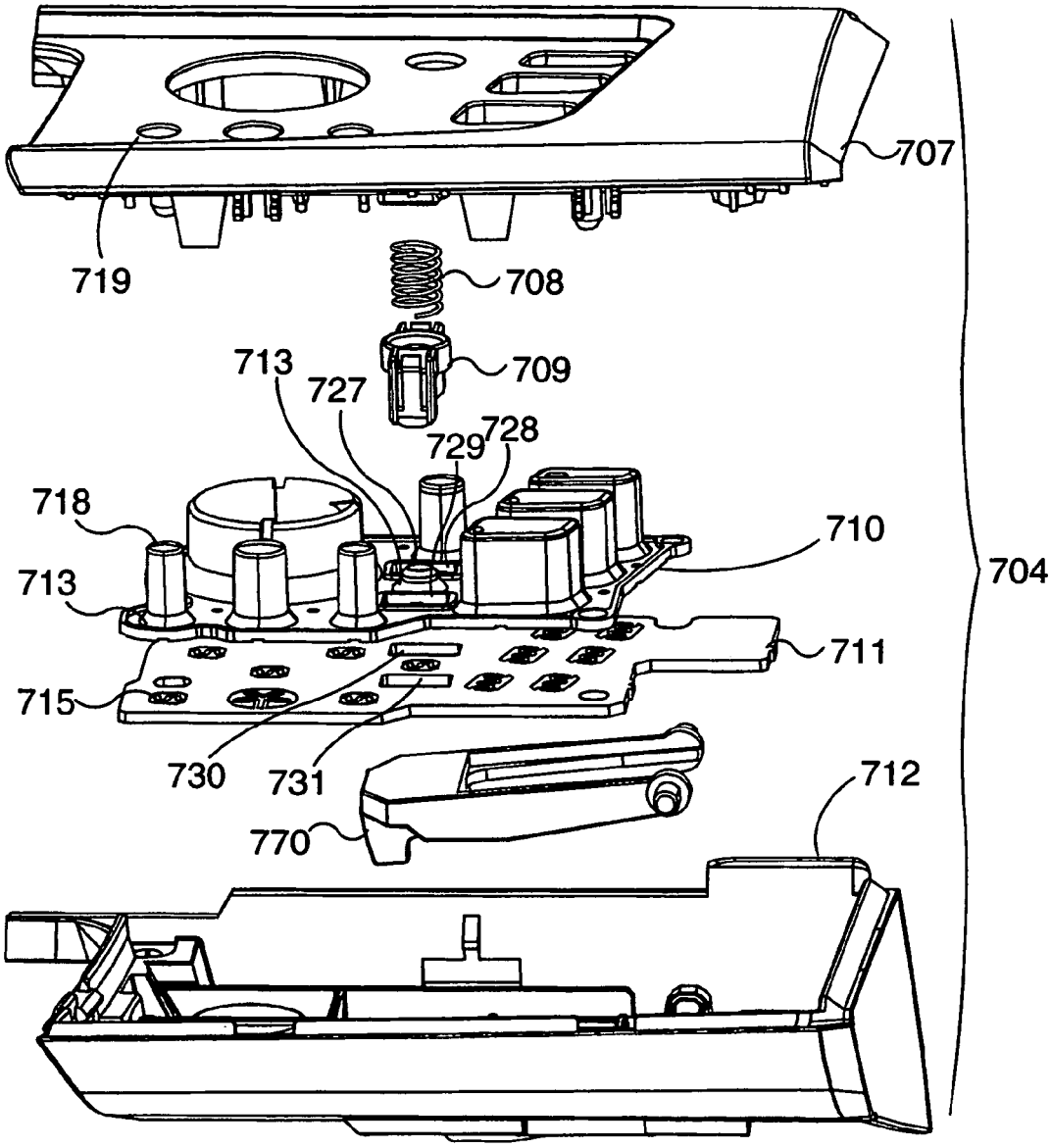
FIG. 20 is an exploded view of the operating panel according to the tenth illustrative embodiment.
Figure 21:
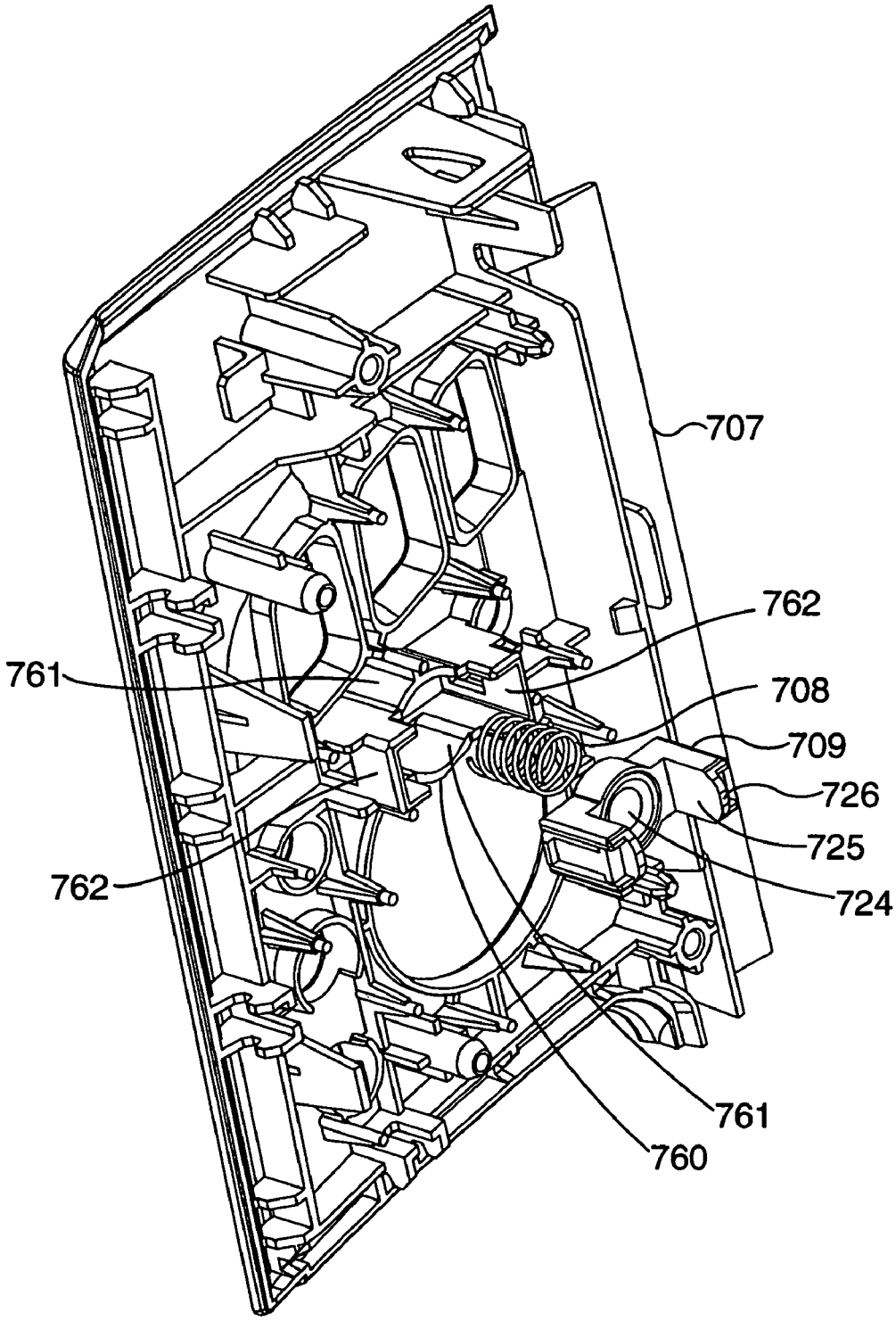
FIG. 21 is an exploded view of the guide and the related parts of the operating panel according to the tenth illustrative embodiment.

A structure of the operating panel 704 will be described with reference to FIGS. 19A to 21. As shown in FIG. 20, the operating panel 704 includes the operating panel cover 707, a first cover 712, a circuit board 711, a rubber spring sheet 710, and a mediate arm 770. The operating panel cover 707 and the first cover 712 may sandwich the circuit board 711 and the rubber spring sheet 710 therebetween. The circuit board 711 may be provided with a number of fixed contacts 715. The rubber spring sheet 710 includes a number of rubber springs 713 which are integral with and continuous with each other and each of which has a traveling contact 714 (FIGS. 19A and 19B) and a head portion 718. The number of keyswitches are implemented by a combination of the circuit board 711 and the rubber spring sheet 710. In order to use one of the number of keyswitches as the opening/closing detection switch 717, an actuator 709 (functioning as a release member) and a spring 708 (functioning as an urging member) are provided so as to be sandwiched between the operating panel cover 707 and the first cover 712.

The opening/closing detection switch 717 may be implemented by a keyswitch having a head portion 727 that is shorter than the head portions 718 of the keyswitches. The opening/closing detection switch 717 may be provided in the empty space when the circuit board 711 and the rubber spring sheet 710 are formed. As a result, no additional cost is incurred.

As described above, because the opening/closing detection switch 717 has the head portion 727 that may be shorter than the head portions 718 of the keyswitches, the head portion 727 of the opening/closing detection switch 717 does not project above the surface of the operating panel cover 707. When the first cover member 703 is opened with respect to the second cover member 702, a base portion 724 of the actuator 709 may be contacted with the head portion 727 of the opening/closing detection switch 717 to press the rubber spring 713 by the urging force of the spring 708 as shown in FIG. 19A. In this state, the traveling contact 714 may be in contact with the fixed contact 715 in the opening/closing detection switch 717, so that it can be detected that the first cover member 703 is located at the uncovering position. The actuator 709 includes two extended portions 725 (FIG. 21) which project from both ends of the base portion 724 and each of which has a tip portion 726. When the first cover member 703 is located at the uncovering position, the tip portions 726 of the extended portions 725 pass through holes 728, 729 provided in the rubber spring sheet 710 and through holes 730, 731 provided in the circuit board 711, respectively, and protrude below the circuit board 711. The mediate arm is apart from the tip portions 726 of the extended portions 725 by its own weight, and the mediate arm is supported by a stopper 751. When the first cover member 703 is closed with respect to the second cover member 712, a second cover 739 upwardly pushes the protruding portion 771 of the mediate arm 770. Then, the mediate arm 770 moves upwardly around the axis 749 that is fixed to the first cover 712, and the top portion 772 of the mediate arm 770 pushes tips portions 726 of the actuator 709 against the urging force of the spring 708, so that the base portion 724 of the actuator 709 may be separated from the head portion 727 and the rubber spring 713 returns to its original state. Thus, the traveling contact 714 may be separated from the fixed contact 715 in the opening/closing detection switch 717, so that it can be detected that the first cover member 703 is located at the covering position with respect to the second cover member 702.

The operating panel cover 707 may be provided with an actuator guide 760. The structures of the actuator guide will be described in detail with reference to FIGS. 19A, 19B and 21. The spring 708 and the base portion 724 of the actuator 709 are fitted in the actuator guide 760. When the actuator 709 is moved, the base portion 724 of the actuator 709 is guided by a pair of center portions 761 of the actuator guide 760, and the extended portions 725 of the actuator 709 are guided by side portions 762 of the actuator guide 760. With this structure, the actuator 709 is allowed to move only in the direction of decreasing/increasing the pressure applied to the rubber spring 713 by the spring 708. Then, the actuator may push and release from the detection switch 717 correctly and the improvement of the reliability of the cover opening/closing detection may be achieved.

While the disclosure has been described in detail with reference to the specific embodiments thereof, it would be apparent to those skilled in the art that various changes, arrangements and modifications may be applied therein without departing from the spirit and scope of the disclosure.

Figure 22A:
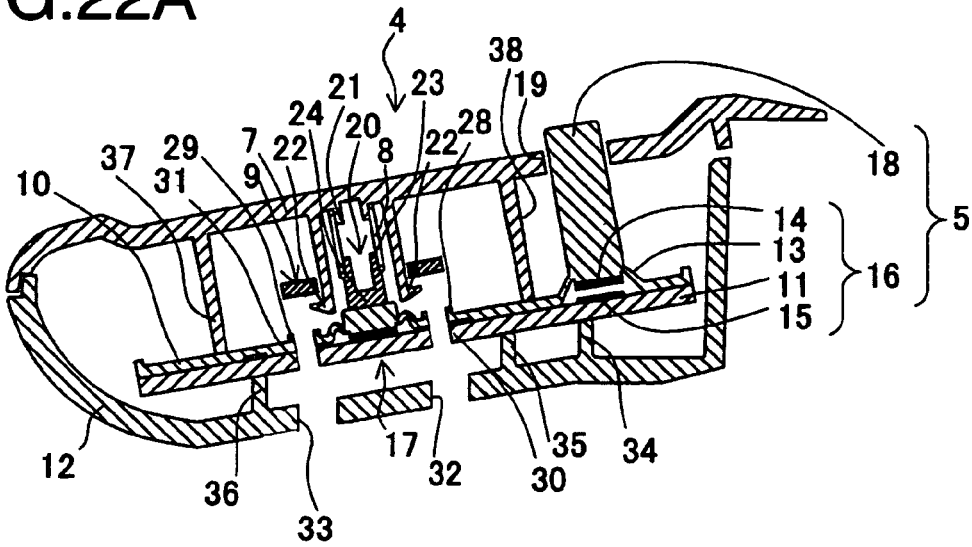
FIG. 22A is a sectional view of the operating panel that is an illustrative change of the first illustrative embodiment shown in FIG. 4A, wherein the extended portions is provided on the second cover member.
Figure 22B:
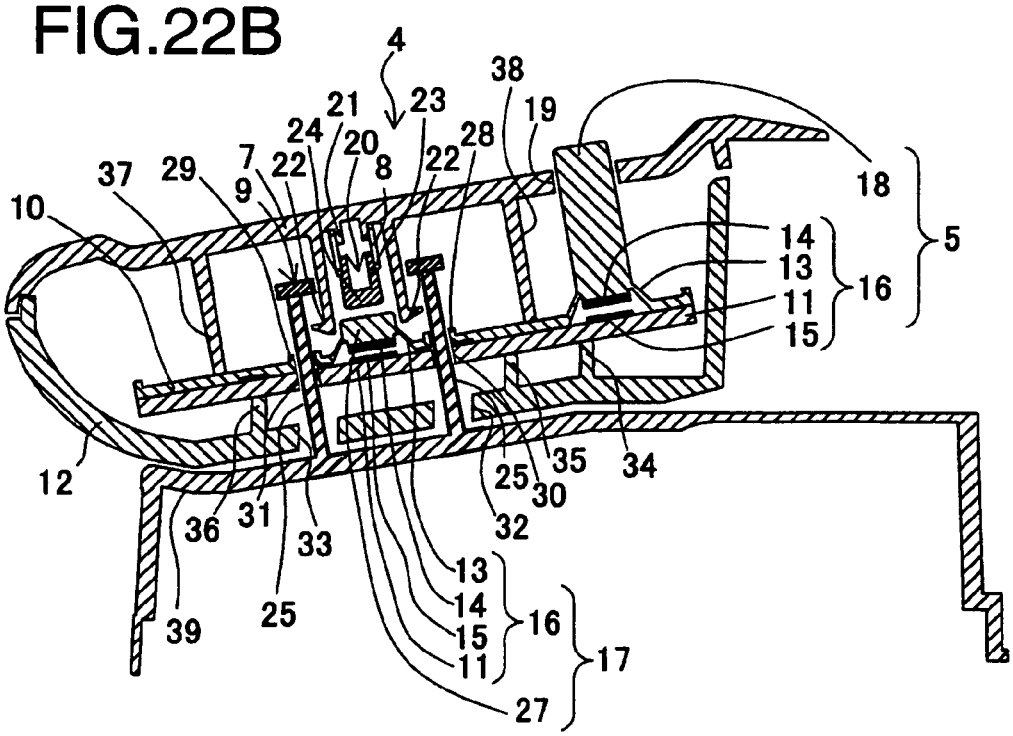
FIG. 22B is a sectional view of the operating panel that is an illustrative change of the first illustrative embodiment shown in FIG. 4B, wherein the extended portions is provided on the second cover member.

For example, in FIGS. 1 and 2, an opening/closing detection switch may be provided on each side of the operating panel 4 in order to detect a tilting of the first cover member 3. And for example, in FIGS. 4A and 4B, protrusions that moves the actuator to detect opening/closing may be provided on the second cover member. As shown in FIGS. 22A and 22B, extended portions 25 is provided on the second cover member 2. When the first cover member 3 is closed with respect to a second cover member 2, the actuator 9 is pushed by the extended portions 25. Then the actuator 9 releases the pressure applied to the rubber spring 13 by the spring 8.

In one aspect of the illustrative embodiment, an information apparatus includes a first cover member that includes an input device capable of inputting data and is capable of opening and closing with respect to a second cover member, and an opening/closing detection device that detects a status of the first cover member whether the first cover member is opened or closed with respect to the second cover member. The input device includes a number of keyswitches, each of which includes a switching portion having a circuit board, which is provided with a fixed contact, and a rubber spring, which has a traveling contact capable of contacting and separating from the fixed contact and which is capable of being elastically deformed by pressure, and the opening/closing detection device includes at least one of the number of keyswitches.

In the information apparatus according one aspect of the illustrative embodiment, the information apparatus includes the number of keyswitches, each of which includes the switching portion having the circuit board, which is provided with the fixed contact, and the rubber spring, which has the traveling contact capable of contacting and separating from the fixed contact and which is capable of being elastically deformed by pressure. Further, the opening/closing detection device includes at least one of the number of keyswitches. With this structure, a special switch for detecting the opening and closing of the first cover member, a special harness for connecting the special switch, and the prevention measures for noise, which is to be caused by the provision of the special harness, can be eliminated. In addition, assembly costs for those parts and a cost for fine adjustment for positioning those parts can be reduced. Further, the fixed contacts of the circuit board and the rubber springs are divided into blocks by function, so that a keyswitch for detecting the opening and closing of the first cover member can be provided in the empty space left between the blocks. Therefore, the circuit board and the rubber spring sheet can be obtained at the same cost as usual, that is, no additional cost is incurred.

In another aspect of the illustrative embodiment, wherein the rubber springs of the number of keyswitches may be integral with each other on a sheet.

With this structure, the assembly of the image forming apparatus can be facilitated and the cost for the rubber spring sheet can be further reduced.

In another aspect of the illustrative embodiment, the keyswitch providing the opening/closing detection device may include an urging member that applies pressure to the rubber spring of the opening/closing detection device, and a release member that releases the pressure applied to the rubber spring by the urging member. When the first cover member is closed with respect to the second cover member, the release member may release the pressure applied to the rubber spring by the urging member.

With this structure, during use of the information apparatus, the first cover member is closed with respect to the second cover member. While the first cover member is closed, the pressure applied to the rubber spring by the urging member is released by the release member, so that the creep deformation can be prevented from developing in the rubber spring of the opening/closing detection device.

In another aspect of the illustrative embodiment, the release member may include a base portion that is disposed between the rubber spring and the urging member of the opening/closing detection device and is capable of pressing the rubber spring of the opening/closing detection device, and an extended portion that passes through through holes provided in the circuit board and the first cover member. When the first cover member is closed with respect to the second cover member, a tip portion of the extended portion contacts the second cover member and the base portion is separated from the rubber spring against the pressure of the urging member, thereby releasing the pressure that is applied to the rubber spring by the urging member.

With this structure, during use of the information apparatus, the first cover member may be closed with respect to the second cover member. While the first cover member is closed, the pressure applied to the rubber spring by the urging member is released by the release member, so that the creep deformation can be prevented from developing in the rubber spring of the opening/closing detection device. A flat area of the second cover member can receive the tip portion of the extended portion of the base portion at any position, so that it is not necessary to perform fine adjustment to the position of the actuator. The opening/closing detection device can be provided at any position within the input device, so that design of the information apparatus is not limited. In addition, the switching function of the opening/closing detection device is implemented by the above-described structure, so that the assembly of the information apparatus can be facilitated.

In another aspect of the illustrative embodiment, the release member may include an actuator whose one end is rotatably supported in the first cover member and another end includes a pressing portion capable of applying the pressure to the rubber spring of the opening/closing detection device and which has a projecting portion between the both ends. When the first cover member is closed with respect to the second cover member, a tip portion of the projecting portion contacts the second cover member and the pressing portion is separated from the rubber spring against the pressure of the urging member, thereby releasing the pressure that is applied to the rubber spring by the urging member.

With this structure, during use of the information apparatus, the first cover member may be closed with respect to the second cover member. While the first cover member is closed, the release member allows the elastic member to release the pressure applied to the rubber spring, so that the creep deformation can be prevented from developing in the rubber spring of the opening/closing detection device. Further, the switching function of the opening/closing detection device is implemented by the above-described structure, so that the assembly of the information apparatus can be facilitated. In addition, the opening/closing detection device can be disposed at the end portion of the first cover member, so that the conveyance of documents is not interrupted in an information apparatus in which the documents passes under an input device to be used for inputting data.

In another aspect of the illustrative embodiment, the opening/closing detection device may include a single keyswitch of the number of keyswitches, an elastic member whose one end is fixed in the first cover member and that includes, at its substantially middle portion, a pressing portion that applies pressure to the rubber spring of the keyswitch, and a projecting portion that is provided at the second cover member. When the first cover member is closed with respect to the second cover member, a tip portion of the projecting portion contacts another end of the elastic member and the pressing portion may be separated from the rubber spring, thereby releasing the pressure that is applied to the rubber spring by the urging member.

With this structure, during use of the information apparatus, the first cover member is closed with respect to the second cover member. While the first cover member is closed, the release member allows the elastic member to release the pressure applied to the rubber spring, so that the creep deformation can be prevented from developing in the rubber spring of the opening/closing detection device. Further the elastic member doubles as an actuator, so that parts count and cost can be reduced. In addition, the structure for detecting the opening and closing of the first cover member becomes simplified, so that space can be saved and a compact design can be achieved in the information apparatus. Further, the reduction of the parts count can increase reliability of the information apparatus.

In another aspect of the illustrative embodiment, the rubber spring of the keyswitch providing the opening/closing detection device may include therein a deformation release member that applies force to the pressing portion to release the elastic deformation caused in the rubber spring.

With this structure, even if the rubber spring is kept pressed for a while unnecessarily, the elastic deformation occurred in the rubber spring can be released. Further, the switching of on and off of the keyswitch can be improved.

In another aspect of the illustrative embodiment, the opening/closing detection device may include a single keyswitch of the number of keyswitches, an actuator that is rotatably supported at its substantially middle portion in the first cover member and whose one end includes a pressing portion capable of applying pressure to the rubber spring of the keyswitch, and a projecting portion that is provided at the second cover member. When the first cover member is closed with respect to the second cover member, a tip portion of the projecting portion contacts another end of the actuator and the pressing portion presses the rubber spring, thereby allowing the traveling contact to contact the fixed contact in the rubber spring of the opening/closing detection device.

The above-described structure may be effective when the opening/closing detection device needs to be maintained at the on state when the first cover member is closed. In addition, the parts count can be kept at a minimum and the parts can be obtained by low-cost resin mold, so that the costs can be reduced.

In another aspect of the illustrative embodiment, the traveling contact may contact the fixed contact for a certain time in the keyswitch providing the opening/closing detection switch in process of closing the first cover member with respect to the second cover member.

With this structure, the contact of the traveling contact and the fixed contact can be used as a trigger signal representing a start of closing the first cover member. Further, when the first cover member is completely closed with respect to the second cover member, the rubber spring returns to its original state on its own, so that the creep deformation can be prevented from developing in the rubber spring. In addition, the occurrence of the creep deformation can be prevented, the reliability of the information apparatus can be ensured and the cost reduction can be achieved with the minimum number of resin mold parts of low costs.

In another aspect of the illustrative embodiment, the opening/closing detection device may include a single keyswitch of the number of keyswitches, an actuator that is rotatably supported at its substantially middle portion by a support portion provided in the first cover member and whose one end includes a pressing portion capable of applying pressure to the rubber spring of the keyswitch, and a projecting portion that is provided at the second cover member and includes an engaging portion capable of engaging and elastically disengaging from another end of the actuator. The engaging portion of the projecting portion is engaged with the another end of the actuator in process of closing the first cover member with respect to the second cover member, so that the pressing portion presses the rubber spring of the opening/closing detection device. The engaging portion may be elastically disengaged from the another end of the actuator when the first cover member completely closed with respect to the second cover member, so that the pressing portion is separated from the rubber spring of the opening/closing detection device. Thus, the traveling contact may be allowed to contact the fixed contact in the rubber spring of the opening/closing detection device for a certain time.

With this structure, the contact of the traveling contact and the fixed contact can be used as a trigger signal representing a start of closing the first cover member. Further, when the first cover member is completely closed with respect to the second cover member, the rubber spring returns to its original state on its own, so that the creep deformation can be prevented from developing in the rubber spring. In addition, the occurrence of the creep deformation can be prevented, the reliability of the information apparatus can be ensured and the cost reduction can be achieved with the minimum number of resin mold parts of low costs.

In another aspect of the illustrative embodiment, the support portion of the actuator may include a restricting member that restricts the rotation of the actuator. The restricting member may assists the engaging portion in elastically disengaging from the another end of the actuator after contacting therewith when the first cover member is opened with respect to the second cover member.

This structure prevents a problem such that the actuator does not normally act when the first cover is closed, because the actuator is undesirably rotated during opening of the first cover member.

In another aspect of the illustrative embodiment, the traveling contact may contact the fixed contact for a certain time in the keyswitch providing the opening/closing detection switch in process of opening the first cover member with respect to the second cover member.

With this structure, the contact of the traveling contact and the fixed contact can be used as a trigger signal representing a start of opening the first cover member. Further, when the first cover member is completely opened with respect to the second cover member, the rubber spring returns to its original state on its own, so that the creep deformation can be prevented from developing in the rubber spring. In addition, the occurrence of the creep deformation can be prevented, the reliability of the information apparatus can be ensured and the cost reduction can be achieved with the minimum number of resin mold parts of low costs.

In another aspect of the illustrative embodiment, the opening/closing detection switch may include a first keyswitch and a second keyswitch of the number of keyswitches. The traveling contact may contact the fixed contact for a certain time in the keyswitch providing the opening/closing detection switch in process of closing the first cover member with respect to the second cover member. The traveling contact may contact the fixed contact for a certain time in the keyswitch providing the opening/closing detection switch in process of opening the first cover member with respect to the second cover member.

With this structure, both when the first cover member is opened and closed with respect to the second cover member, the rubber springs of the first and second keyswitches can return to their original state on its own, so that the creep deformation can be prevented from developing in the first and second keyswitches. In addition, trigger signals indicating the opening and closing of the first cover member can be outputted both when the first cover member is opened and closed with respect to the second cover member.

In another aspect of the illustrative embodiment, the opening/closing detection device may further include an actuator that may be rotatably supported at its substantially middle portion by a support portion provided between the first and second keyswitches in the first cover member and includes a first pressing portion capable of applying pressure to the rubber spring of the first keyswitch at its one end and a second pressing portion capable of applying pressure to the rubber spring of the second keyswitch at its another end, and a projecting portion that may be provided at the second cover member and includes an engaging portion that is elastically engaging and disengaging from the actuator. In process of closing the first cover member with respect to the second cover member, the engaging portion of the projecting portion may be engaged with the actuator to allow the first pressing portion to press the rubber spring of the first keyswitch switch. When the first cover member is completely closed with respect to the second cover member, the engaging portion of the projecting portion may be elastically disengaged from the actuator to allow the first pressing portion to release the pressure applied to the rubber spring of the first keyswitch, so that the traveling contact may contact the fixed contact for a certain time in the first keyswitch providing the opening/closing detection switch. In process of opening the first cover member with respect to the second cover member, the engaging portion of the projecting portion may be engaged with the actuator to allow the second pressing portion to press the rubber spring of the second keyswitch switch. When the first cover member is completely closed with respect to the second cover member, the engaging portion of the projecting portion may be elastically disengaged from the actuator to allow the second pressing portion to release the pressure applied to the rubber spring of the second keyswitch, so that the traveling contact may contact the fixed contact for a certain time in the second keyswitch providing the opening/closing detection switch.

With this structure, both when the first cover member may be opened and closed with respect to the second cover member, the rubber springs of the first and second keyswitches can return to their original state on its own, so that the creep deformation can be prevented from developing in the first and second keyswitches. In addition, trigger signals indicating the opening and closing of the first cover member can be outputted both when the first cover member may be opened and closed with respect to the second cover member.

In another aspect of the illustrative embodiment, the deformation release member may be a traveling contact including a conductive elastic member.

With this structure, the switching of on and off of the keyswitch can be improved.

In another aspect of the illustrative embodiment, the keyswitch providing the opening/closing detection switch may include an annular fixed contact and an annular traveling contact which are disposed coaxially with a center of the rubber spring so as to be in contact with each other. The circuit board may be provided with a through hole so as to be coaxial with a center of the annular fixed contact. The second cover member may be provided with a projecting portion. When the first cover member may be closed with respect to the second cover member, a tip portion of the projecting portion may upwardly push the center of the rubber spring via the through hole, thereby allowing the traveling contact separate from the fixed contact.

With this structure, it is unnecessary to provide an elastic member for always applying a pressing force to the rubber spring. In addition, a movable member does not exist between the annular fixed contact and the annular traveling contact, so that a manufacturing cost can be reduced. Further, the reduction of the parts count can improve reliability of the information apparatus.

In another aspect of the illustrative embodiment, the rubber spring of the opening/closing detection device may include an elastic member at its head portion to apply pressure so that the annular fixed contact and the annular traveling contact are in contact with each other.

With this structure, when the first cover member is opened with respect to the second cover member, the opening/closing detection device can be surely maintained in the on state, thereby improving the reliability of the information apparatus.

In another aspect of the illustrative embodiment, the information apparatus includes the guide that guides the release member in the direction of decreasing/increasing the pressure applied to the rubber spring by the urging member.

With this structure, the release member may actuate opening/closing detection device correctly and the improvement of the reliability of the cover opening/closing detection may be achieved.

What is claimed is:

1. An information apparatus comprising:

a first cover member that includes an input device capable of inputting data and is capable of opening and closing with respect to a second cover member; and an opening/closing detection device that detects a status of the first cover member whether the first cover member is opened or closed with respect to the second cover member, wherein the input device includes a plurality of keyswitches, each of which includes a switching portion having a circuit board, the circuit board being separate from the second cover member, the circuit board being provided with a fixed contact, and a rubber spring, which has a traveling contact capable of contacting and separating from the fixed contact and which is capable of being elastically deformed by pressure, and the opening/closing detection device includes at least one of the plurality of keyswitches.

2. The information apparatus according to claim 1, wherein the rubber springs of the plurality of keyswitches are integral with each other on a sheet.

3. The information apparatus according to claim 1, wherein the keyswitch providing the opening/closing detection device includes:

an urging member that applies pressure to the rubber spring thereof; and a release member that releases the pressure applied to the rubber spring by the urging member, wherein when the first cover member is closed with respect to the second cover member, the release member releases the pressure applied to the rubber spring by the urging member.

4. The information apparatus according to claim 3, wherein the release member includes:

a base portion that is disposed between the rubber spring and the urging member and is capable of pressing the rubber spring; and an extended portion that passes through holes provided in the circuit board and the first cover member, and wherein, when the first cover member is closed with respect to the second cover member, a tip portion of the extended portion contacts the second cover member and the base portion is separated from the rubber spring against the pressure of the urging member, thereby releasing the pressure that is applied to the rubber spring by the urging member.

5. The information apparatus according to claim 4, further comprising a guide that guides the release member in the direction of decrease/increase the pressure applied to the rubber spring by the urging member, the guide having portions that guides the base portion of the release member and portions that guides extended portions of the release member.

6. The information apparatus according to claim 5, wherein the urging member is provided in the guide.

7. The information apparatus according to claim 3, wherein the release member includes an actuator whose one end is rotatably supported in the first cover member and another end includes a pressing portion capable of applying the pressure to the rubber spring and which has a projecting portion between the both ends, and wherein when the first cover member is closed with respect to the second cover member, a tip portion of the projecting portion contacts the second cover member and the pressing portion is separated from the rubber spring against the pressure of the urging member, thereby releasing the pressure that is applied to the rubber spring by the urging member.

8. The information apparatus according to claim 3, further comprising a guide that guides the release member in the direction of decrease/increase the pressure applied to the rubber spring by the urging member.

9. The information apparatus according to claim 1, wherein the opening/closing detection device includes:

a single keyswitch of the plurality of keyswitches;

an elastic member whose one end is fixed in the first cover member and that includes, at its substantially middle portion, a pressing portion that applies pressure to the rubber spring of the keyswitch; and a projecting portion that is provided at the second cover member, and wherein when the first cover member is closed with respect to the second cover member, a tip portion of the projecting portion contacts another end of the elastic member and the pressing portion is separated from the rubber spring, thereby releasing the pressure that is applied to the rubber spring by the urging member.

10. The information apparatus according to claim 9, wherein the rubber spring of the keyswitch providing the opening/closing detection device includes therein a deformation release member that applies force to the pressing portion to release the elastic deformation caused in the rubber spring.

11. The information apparatus according to claim 1, wherein the opening/closing detection device includes:

a single keyswitch of the plurality of keyswitches;

an actuator that is rotatably supported at its substantially middle portion in the first cover member and whose one end includes a pressing portion capable of applying pressure to the rubber spring of the keyswitch; and a projecting portion that is provided at the second cover member, wherein when the first cover member is closed with respect to the second cover member, a tip portion of the projecting portion contacts another end of the actuator and the pressing portion presses the rubber spring, thereby allowing the traveling contact to contact the fixed contact in the rubber spring of the opening/closing detection device.

12. The information apparatus according to claim 11, wherein the rubber spring of the keyswitch providing the opening/closing detection device includes therein a deformation release member that applies force to the pressing portion to release the elastic deformation caused in the rubber spring.

13. The information apparatus according to claim 1, wherein the traveling contact contacts the fixed contact for a certain time in the keyswitch providing the opening/closing detection device in process of closing the first cover member with respect to the second cover member.

14. The information apparatus according to claim 13, wherein the opening/closing detection device includes:

a single keyswitch of the plurality of keyswitches;

an actuator that is rotatably supported at its substantially middle portion by a support portion provided in the first cover member and whose one end includes a pressing portion capable of applying pressure to the rubber spring of the keyswitch; and a projecting portion that is provided at the second cover member and includes an engaging portion capable of engaging and elastically disengaging from another end of the actuator, wherein the engaging portion of the projecting portion is engaged with the another end of the actuator in process of closing the first cover member with respect to the second cover member, so that the pressing portion presses the rubber spring of the opening/closing detection device, and the engaging portion is elastically disengaged from the another end of the actuator when the first cover member completely closed with respect to the second cover member, so that the pressing portion is separated from the rubber spring of the opening/closing detection device, thereby allowing the traveling contact to contact the fixed contact in the rubber spring of the opening/closing detection device for a certain time.

15. The information apparatus according to claim 14, wherein the support portion of the actuator includes a restricting member that restricts the rotation of the actuator, and wherein the restricting member assists the engaging portion in elastically disengaging from the another end of the actuator after contacting therewith when the first cover member is opened with respect to the second cover member.

16. The information apparatus according to claim 1, wherein the traveling contact contacts the fixed contact for a certain time in the keyswitch providing the opening/closing detection device in process of opening the first cover member with respect to the second cover member.

17. The information apparatus according to claim 1, wherein the opening/closing detection device includes a first keyswitch and a second keyswitch of the plurality of keyswitches, wherein the traveling contact contacts the fixed contact for a certain time in the keyswitch providing the opening/closing detection device in process of closing the first cover member with respect to the second cover member, and wherein the traveling contact contacts the fixed contact for a certain time in the keyswitch providing the opening/closing detection device in process of opening the first cover member with respect to the second cover member.

18. The information apparatus according to claim 17, wherein the opening/closing detection device further includes:

an actuator that is rotatably supported at its substantially middle portion by a support portion provided between the first and second keyswitches in the first cover member and includes a first pressing portion capable of applying pressure to the rubber spring of the first keyswitch at its one end and a second pressing portion capable of applying pressure to the rubber spring of the second keyswitch at its another end; and a projecting portion that is provided at the second cover member and includes an engaging portion that is elastically engaging and disengaging from the actuator, wherein in process of closing the first cover member with respect to the, second cover member, the engaging portion of the projecting portion is engaged with the actuator to allow the first pressing portion to press the rubber spring of the first keyswitch switch, wherein when the first cover member is completely closed with respect to the second cover member, the engaging portion of the projecting portion is elastically disengaged from the actuator to allow the first pressing portion to release the pressure applied to the rubber spring of the first keyswitch, so that the traveling contact contacts the fixed contact for a certain time in the first keyswitch providing the opening/closing detection device, wherein in process of opening the first cover member with respect to the second cover member, the engaging portion of the projecting portion is engaged with the actuator to allow the second pressing portion to press the rubber spring of the second keyswitch switch, and wherein when the first cover member is completely closed with respect to the second cover member, the engaging portion of the projecting portion is elastically disengaged from the actuator to allow the second pressing portion to release the pressure applied to the rubber spring of the second keyswitch, so that the traveling contact contacts the fixed contact for a certain time in the second keyswitch providing the opening/closing detection device.

19. The information apparatus according to claim 1, wherein the rubber spring of the keyswitch providing the opening/closing detection device includes therein a deformation release member that releases the elastic deformation occurred in the rubber spring.

20. The information apparatus according to claim 19, wherein the deformation release member is a conductive elastic member including a traveling contact.

21. The information apparatus according to claim 1, wherein the keyswitch providing the opening/closing detection device includes an annular fixed contact and an annular traveling contact which are disposed coaxially with a center of the rubber spring so as to be in contact with each other, wherein the circuit board is provided with a through hole so as to be coaxial with a center of the annular fixed contact, wherein the second cover member is provided with a projecting portion, and wherein when the first cover member is closed with respect to the second cover member, a tip portion of the projecting portion upwardly pushes the center of the rubber spring via the through hole, thereby allowing the traveling contact separate from the fixed contact.

22. The information apparatus according to claim 21, wherein the rubber spring includes an elastic member at its head portion to apply pressure so that the annular fixed contact and the annular traveling contact are in contact with each other.

23. The information apparatus according to claim 1, further comprising at least one protrusion that directly or indirectly activate the opening/closing detection device.

24. The information apparatus according to claim 23, wherein the at least one protrusion is provided in the first cover member.

25. The information apparatus according to claim 23, wherein the at least one protrusion is provided in the second cover member.

26. An information apparatus comprising:

a first cover member that includes an input device capable of inputting data and is capable of opening and closing with respect to a housing; and an opening/closing detection device that detects a status of the first cover member whether the first cover member is opened or closed with respect to the housing, wherein the input device includes a plurality of keyswitches, at least one of which includes a switching portion having a circuit board, the circuit board being separate from the second cover member, the circuit board having a fixed contact and a biasing device, said biasing device having a traveling contact capable of contacting and separating from the fixed contact and which is capable of being elastically deformed by pressure, and the opening/closing detection device includes said at least one of the plurality of keyswitches.

27. An information apparatus comprising:

a housing;

a first cover member that includes an input device capable of inputting data and is capable of opening and closing with respect to a second cover member, the second cover member configured to open and close with respect to the housing; and an opening/closing detection device that detects a status of the first cover member whether the first cover member is opened or closed with respect to the second cover member, wherein the input device includes a plurality of keyswitches, each of which includes a switching portion having a circuit board, the circuit board being separate from the second cover member, the circuit board being provided with a fixed contact, and a rubber spring, which has a traveling contact capable of contacting and separating from the fixed contact and which is capable of being elastically deformed by pressure, and the opening/closing detection device includes at least one of the plurality of keyswitches.

* * * * *

UNITED STATES PATENT AND TRADEMARK OFFICE

CERTIFICATE OF CORRECTION

PATENT NO. : 7,572,989 B2
APPLICATION NO. : 11/288082
DATED : August 11, 2009
INVENTOR(S) : Teruo Deshimaru It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 213 days.

Signed and Sealed this

Seventh Day of September, 2010

David J. Kappos

David J. Kappos
*Director of the United States Patent and Trademark Office*